US006631538B1

(12) United States Patent
Carr

(10) Patent No.: US 6,631,538 B1
(45) Date of Patent: Oct. 14, 2003

(54) SELF-CLOSING CLASP ASSEMBLY

(76) Inventor: Kathleen Cosgriff Carr, 159 E. 70th St., Apt. 4R, New York, NY (US) 10021

( * ) Notice: Subject to any disclaimer, the term of this patent is extended or adjusted under 35 U.S.C. 154(b) by 0 days.

(21) Appl. No.: 09/438,559

(22) Filed: Nov. 10, 1999

(51) Int. Cl.[7] ..... A44C 3/00
(52) U.S. Cl. ..... 24/299; 24/300; 24/3.13
(58) Field of Search ..... 24/300, 298, 3.1, 24/3.13, 3.12, 336, 338, 339, 334, 331, 499, 500, 501, 509, 511

(56) References Cited

U.S. PATENT DOCUMENTS

| | | | | | |
|---|---|---|---|---|---|
| D10,319 | S | * | 11/1877 | Kempshall | D8/382 |
| 240,670 | A | * | 4/1881 | Davidson | 24/265 H |
| D12,284 | S | * | 5/1881 | Willcox | D8/367 |
| D26,732 | S | * | 3/1897 | Covert | 24/265 R |
| D27,752 | S | * | 10/1897 | Prindle | D8/382 |
| 615,345 | A | * | 12/1898 | Cummings | D8/382 |
| 835,421 | A | * | 11/1906 | Heidt | 24/598.5 |
| 966,322 | A | * | 8/1910 | Ellison | 24/599.8 |
| 968,084 | A | * | 8/1910 | Schartow | 24/375 |
| 1,052,959 | A | * | 2/1913 | Ramsberger | 248/317 |
| D44,288 | S | * | 7/1913 | Reynolds | D8/382 |
| 1,233,538 | A | * | 7/1917 | Alden | 248/317 X |
| 1,392,816 | A | * | 10/1921 | Crocker | |
| 1,406,458 | A | * | 2/1922 | Jacobson | 24/573.4 |
| 1,635,333 | A | * | 7/1927 | Mickleborough | |
| 1,688,506 | A | * | 10/1928 | Rivers | |
| 2,036,743 | A | * | 4/1936 | Cohn | |
| 2,037,089 | A | * | 4/1936 | Pollack | |
| 2,037,449 | A | * | 4/1936 | Baer | |
| 2,487,339 | A | * | 11/1949 | Kindlund | |
| 2,861,547 | A | * | 11/1958 | Dale | 119/797 |
| 2,962,784 | A | * | 12/1960 | Gianios | |
| 3,893,725 | A | * | 7/1975 | Coulter et al. | 24/306 X |
| D285,989 | S | * | 10/1986 | MacDonald | D8/382 |
| D289,739 | S | * | 5/1987 | Froidevaux et al. | D8/395 |
| 5,042,704 | A | * | 8/1991 | Izzo | 206/315.4 R |
| 5,117,538 | A | * | 6/1992 | Henry | 24/298 |
| D328,668 | S | * | 8/1992 | Legrand | D8/395 X |
| D329,744 | S | * | 9/1992 | Moore | D3/27 |
| D331,462 | S | * | 12/1992 | Kraus et al. | D8/395 X |

(List continued on next page.)

OTHER PUBLICATIONS

I–Fuii, back page, chains,items A and B located at top of page (copy in examiner's office), Aug. 1995.*
I–Fuii, p. 29, spring snap, located at left of page (copy in examiner's office), Aug. 1995.*

(List continued on next page.)

*Primary Examiner*—Robert J. Sandy
(74) *Attorney, Agent, or Firm*—White & Case LLP

(57) ABSTRACT

The present invention provides a Self-Closing Clasp Assembly designed to allow a loose object to be easily attached to an object that is already being conveniently handled or carried by a person. The Self-Closing Clasp Assembly is comprised of three elements: a Self-Closing Element linked by an Elongated Element to a Connecting Element. The Self-Closing Element is sized to grasp around an object that is relatively structural in nature, such as a shoulder-bag strap, belt or strap on a golfbag and is designed to be operated with one hand. The Self-Closing Element preferably comprises a self-closing clasp, or ring. The Elongated Element can be rigid or flexible and is preferably formed by items such as one or more chain links, an adjustable or fixed-length strap, or a bar, and is preferably used to link the Self-Closing Element to the Connecting Element. The Connecting Element preferably consists of a self-closing clasp, clip, clasp, bolt, finial, or ring and is designed to be affixed to the loose object.

19 Claims, 49 Drawing Sheets

U.S. PATENT DOCUMENTS

| | | | | | |
|---|---|---|---|---|---|
| D339,885 | S | * | 9/1993 | Rebek | D30/153 |
| 5,351,654 | A | * | 10/1994 | Fuentes | 119/795 X |
| 5,615,454 | A | * | 4/1997 | Contarino | 24/3.13 |
| D382,379 | S | * | 8/1997 | Smith | D30/153 |
| D394,382 | S | * | 5/1998 | Knight | D8/395 |
| D407,300 | S | * | 3/1999 | Catlett | D8/367 |
| 5,884,371 | A | * | 3/1999 | Huggins | 24/300 |
| D407,867 | S | * | 4/1999 | Rubinstein | D30/153 |
| 5,915,336 | A | * | 6/1999 | Watson | 119/797 |
| D413,252 | S | * | 8/1999 | Striebel | D8/367 |

OTHER PUBLICATIONS

I–Fuii, p. 4, spring snap, located at left of page (copy in examiner's office), Aug. 1995.*

I–Fuii catalog, back page, chain lead items a and b located at top of page (copy in examiner's office), Aug. 1995.*

I–Fuii Enterprise Co. Catalog, p. 6, spring snap located at left of page (copy in examiner's office), Aug. 1995.*

I–Fuii Enterprise Co. Catalog, p. 29, spring snap located at left of page (copy in examiner's office), Aug. 1995.*

I–Fuii catalog,back page, chain lead item A at top of page (copy in examiner's office), Aug. 1995.*

I–Fuii catalog, p. 6, trigger snap, item 4219Z at top of page (copy in examiner's office), Aug. 1995.*

I–Fuii catalog, p. 6, spring snap located at left of page (copy in examiner's office), Aug. 1995.*

I–Fuii catalog, back page, chain lead located at top of page (copy in examiner's office), Aug. 1995.*

I–Fuii catalog, p. 29, spring snap located at left of page (copy in examiner's office), Aug. 1995.*

Nat'l Webbing Catalog, Website View Nov. 8, 1999, #108 Padded Luggage Strap.

* cited by examiner

40

SELF-CLOSING CLASP ASSEMBLY

CROSS REFERENCE TO RELATED APPLICATIONS

This application for patent for the Self-Closing Clasp Assembly relates to twelve (12) concurrently submitted design patent applications for twelve (12) embodiments of the Self-Closing Clasp Assembly.

FIELD OF INVENTION

This invention relates to Self-Closing Clasp Assemblies. More particularly, it relates to a Self-Closing Clasp Assembly that is used to connect a loose object, such as an umbrella, hammer, or towel, to another more stationary or structural object, such as a shoulder-bag strap, belt, or golfbag. The Self-Closing Clasp Assembly of the invention provides a practical and efficient means for a person carrying a loose object to free his/her hands for other activities while keeping the loose object handy.

BACKGROUND OF THE INVENTION

Persons who perform multiple tasks simultaneously are often encumbered by the need to hold several items at once. They seek ways to free their hands to allow them to perform additional tasks or to perform their current tasks more efficiently or more comfortably, while keeping the items they need handy. Here is an example of such a situation. An adult commuter on the subway finds herself carrying a shoulder bag, a newspaper she would like to read during the commute, and a wet umbrella. It is impossible to get a seat, so she finds she must also have a free hand to hold a subway car strap. In order to do this she can choose among several options. One option is to put the wet umbrella into her shoulder bag. She hesitates to do this because the umbrella may not be small enough to fit within the shoulder bag or, worse, the other items within the shoulder bag would be dampened by the wet umbrella. A second option would be to put the umbrella within a protective plastic bag before inserting it within the shoulder bag. However, she didn't remember to bring a plastic bag with her and anyway the plastic bag would probably leak or spill water after use. A third option would be to put the existing hand strap (or hook handle) over her wrist, or arm. Again, she hesitates to do this because she is afraid that the umbrella would become entangled in her hand and in the newspaper when she turns the page of the paper, or that the umbrella would rest against her arm or body. A particular disadvantage of doing this with the hook-handle umbrella is that the umbrella is easily knocked off the arm, especially if the arm is held at an angle for purposes of holding a subway strap or a newspaper.

Accordingly, there is a need for a simple and convenient way for persons to attach loose objects to other objects either on their person or which they are already comfortably handling, thereby freeing their hands for other activities while maintaining the loose objects handy.

SUMMARY OF THE INVENTION

The present invention provides a Self-Closing Clasp Assembly designed to allow a loose object to be easily attached to an object that is already being conveniently handled or carried by a person. The Self-Closing Clasp Assembly is comprised of three elements: a Self-Closing Element linked by an Elongated Element to a Connecting Element. The Self-Closing Element is sized to grasp around an object that is relatively structural in nature, such as a shoulder-bag strap, belt or strap on a golfbag and is designed to be operated with one hand. The Self-Closing Element preferably comprises a self-closing clasp, or ring. The Elongated Element can be rigid or flexible and is preferably formed by items such as one or more chain links, an adjustable or fixed-length strap, or a bar, and is preferably used to link the Self-Closing Element to the Connecting Element. The Connecting Element preferably consists of a self-closing clasp, clip, clasp, bolt, finial, or ring and is designed to be affixed to the loose object. The Connecting Element may be permanently affixed to the loose object. Both the Self-Closing Element and the Connecting Element may be attached to the Elongated Element through the use of swivel rings to allow for greater flexibility of movement. For example, when the Self-Closing Clasp Assembly is used to hang a hammer from a tool belt, the Self-Closing Element will be a self-closing clasp sized to clasp around the tool belt or around a loop on the tool belt, the Connecting Element may also be a self-closing clasp that is sized to firmly grasp around the hammer head or around the handle, and the Elongated Element that connects the Self-Closing Element to the Connecting Element may be constructed of materials such as a chain or leather strap, all options depending upon consumer preference.

The advantages and objectives of the invention will be apparent from the following description and drawings.

DETAILED DESCRIPTION

The Self-Closing Clasp Assembly of the present invention is comprised of a Self-Closing Element linked by a flexible or rigid Elongated Element to a Connecting Element. The Self-Closing Element A is sized to grasp around an object which is relatively structural in nature, such as a shoulder-bag strap, belt or strap on a golfbag and is designed to be operated with one hand. The Self-Closing Element preferably comprises a self-closing clasp, or ring. The Elongated Element can be rigid or flexible and is preferably formed by items such as one or more chain links, an adjustable or fixed-length strap, or a bar, and is preferably used to link the Self-Closing Element to the Connecting Element. The Connecting Element preferably consists of a self-closing clasp, clip, clasp, bolt, finial, or ring and is designed to be affixed to the loose object. The Connecting Element may be permanently affixed to the loose object. Both the Self-closing Element and the Connecting Element may be attached to the Elongated Element through the use of swivel rings to allow for greater flexibility of movement.

Figure 1A:
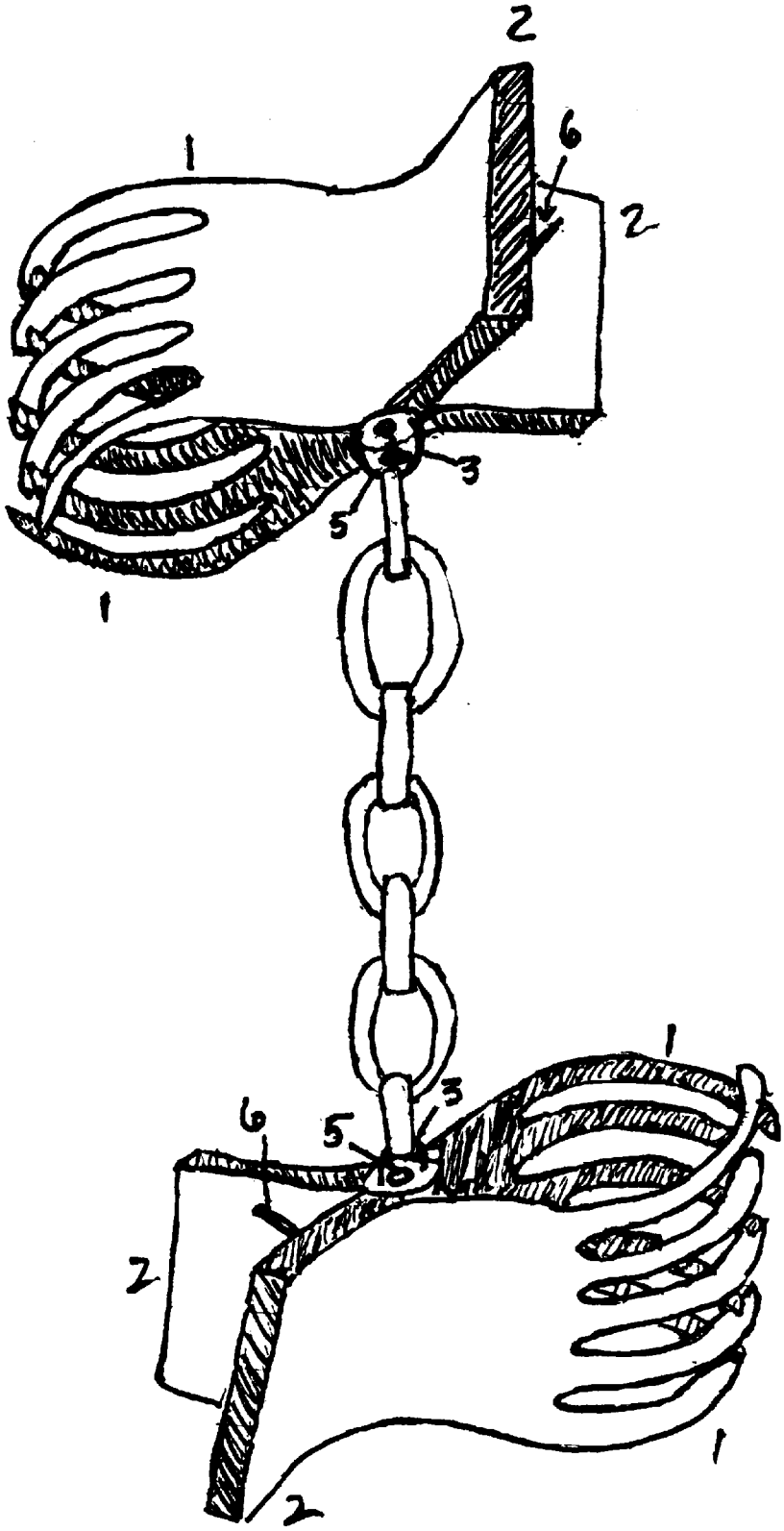
FIG. 1A shows a side perspective view of one embodiment of the Self-Closing Clasp Assembly of the present invention wherein the Self-Closing Element and the Connecting Element are comprised of identical concave-curved, interlocking-teeth self-closing clasps.
Figure 1B:
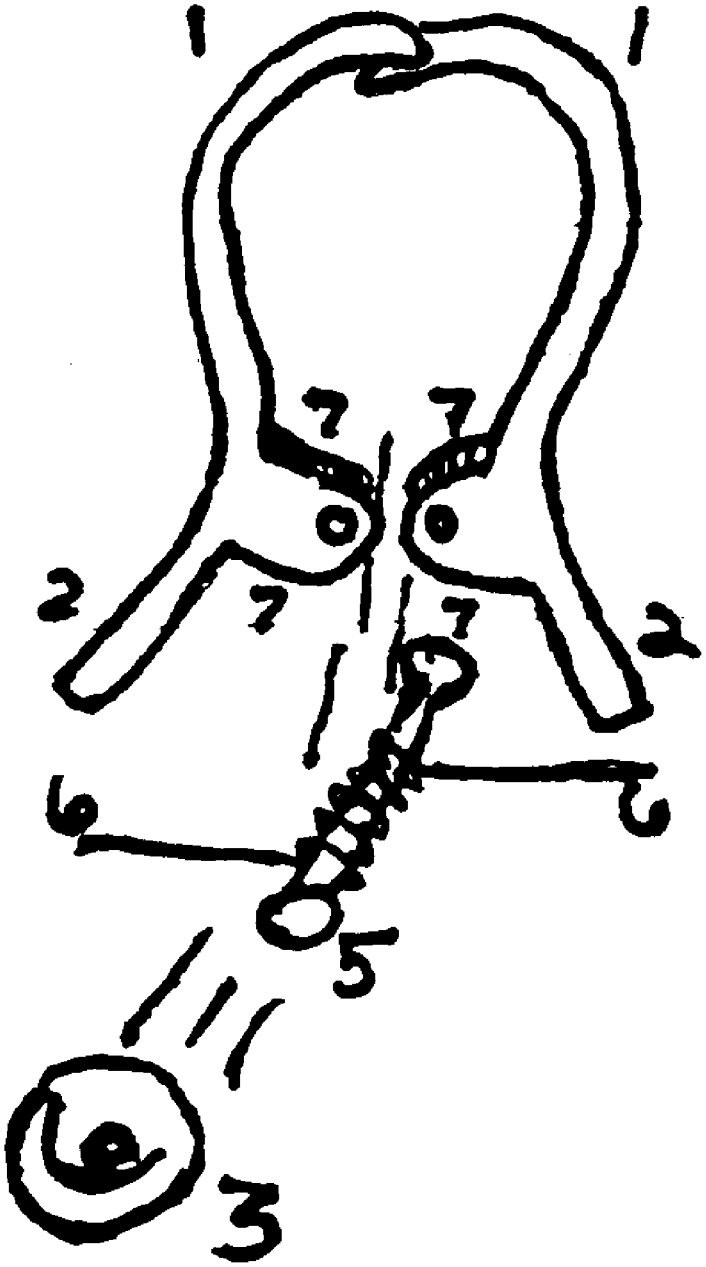
FIG. 1B shows a top plan view of the component parts of one of the concave-curved, interlocking-teeth, self-closing clasps shown in FIG. 1A.
Figure 1C:
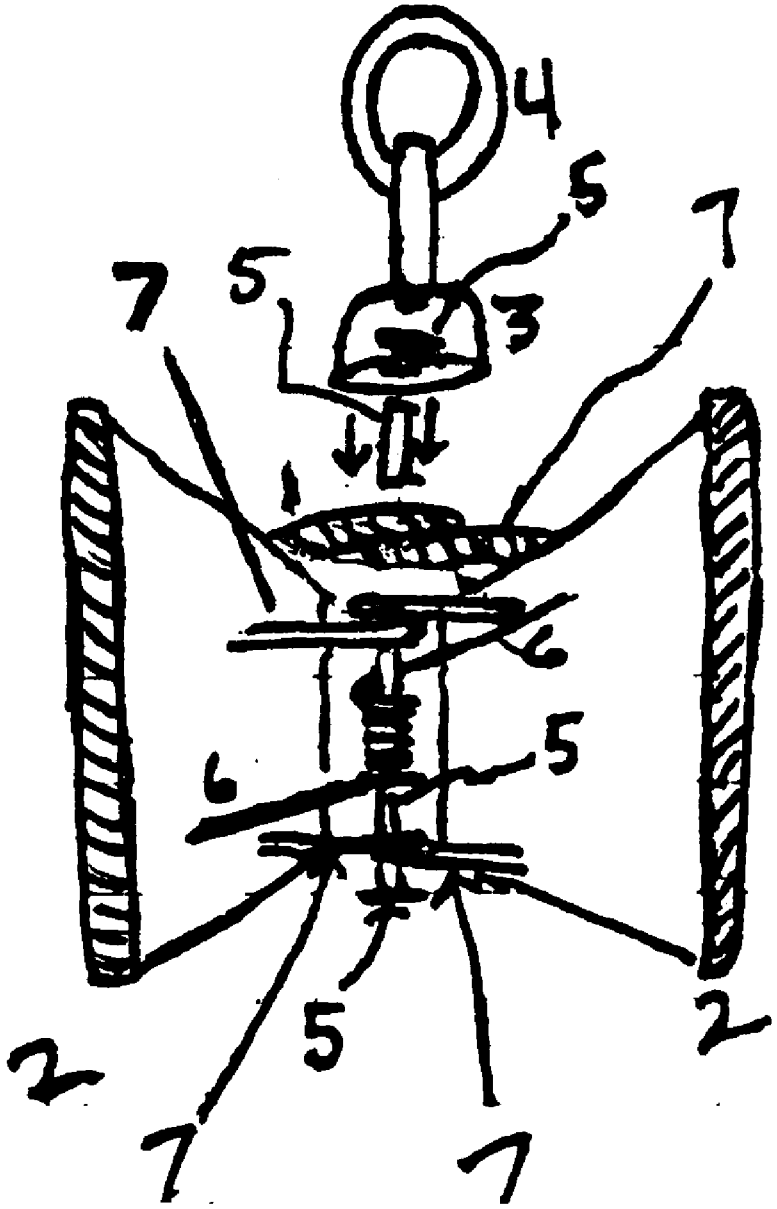
FIG. 1C shows a rear perspective view of one of the concave-curved, interlocking-teeth, self-closing clasps shown in FIG. 1A as it attaches to the Elongated Element.
Figure 1D:
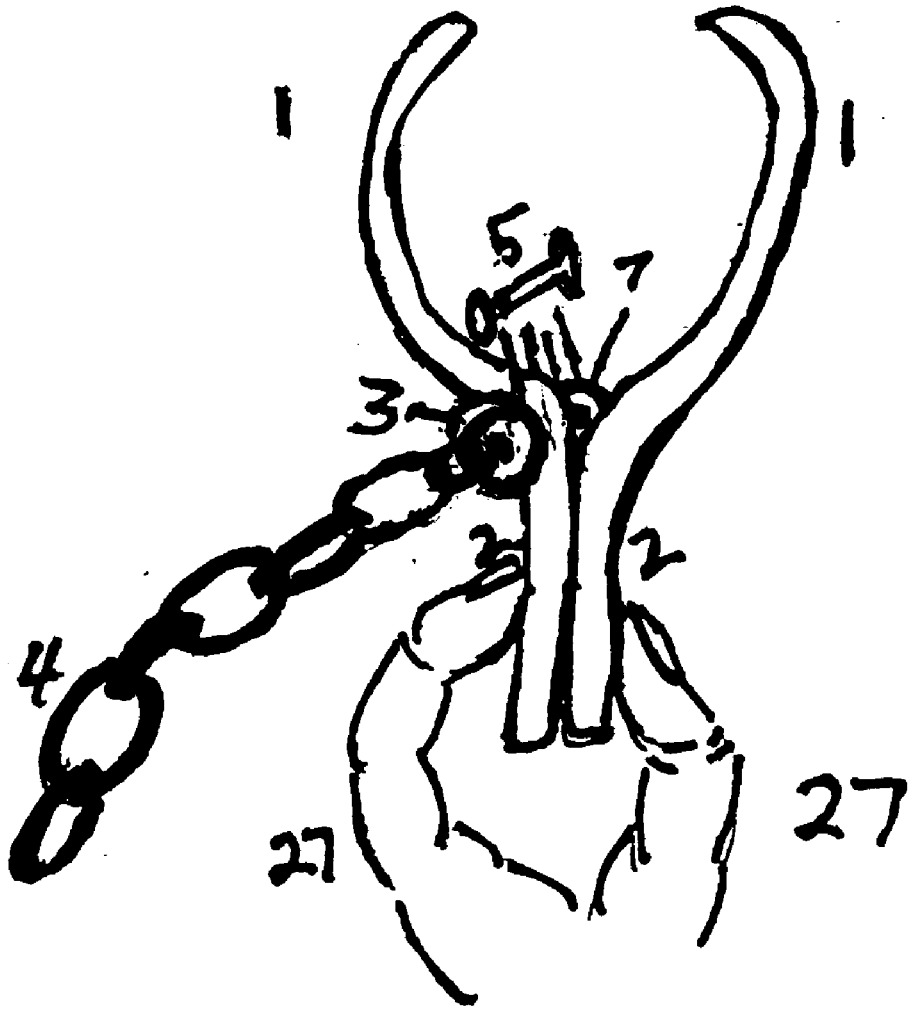
FIG. 1D shows a top plan view of one of the self-closing clasps shown in FIG. 1A in the open position, as it attaches to the Elongated Element.
Figure 20:
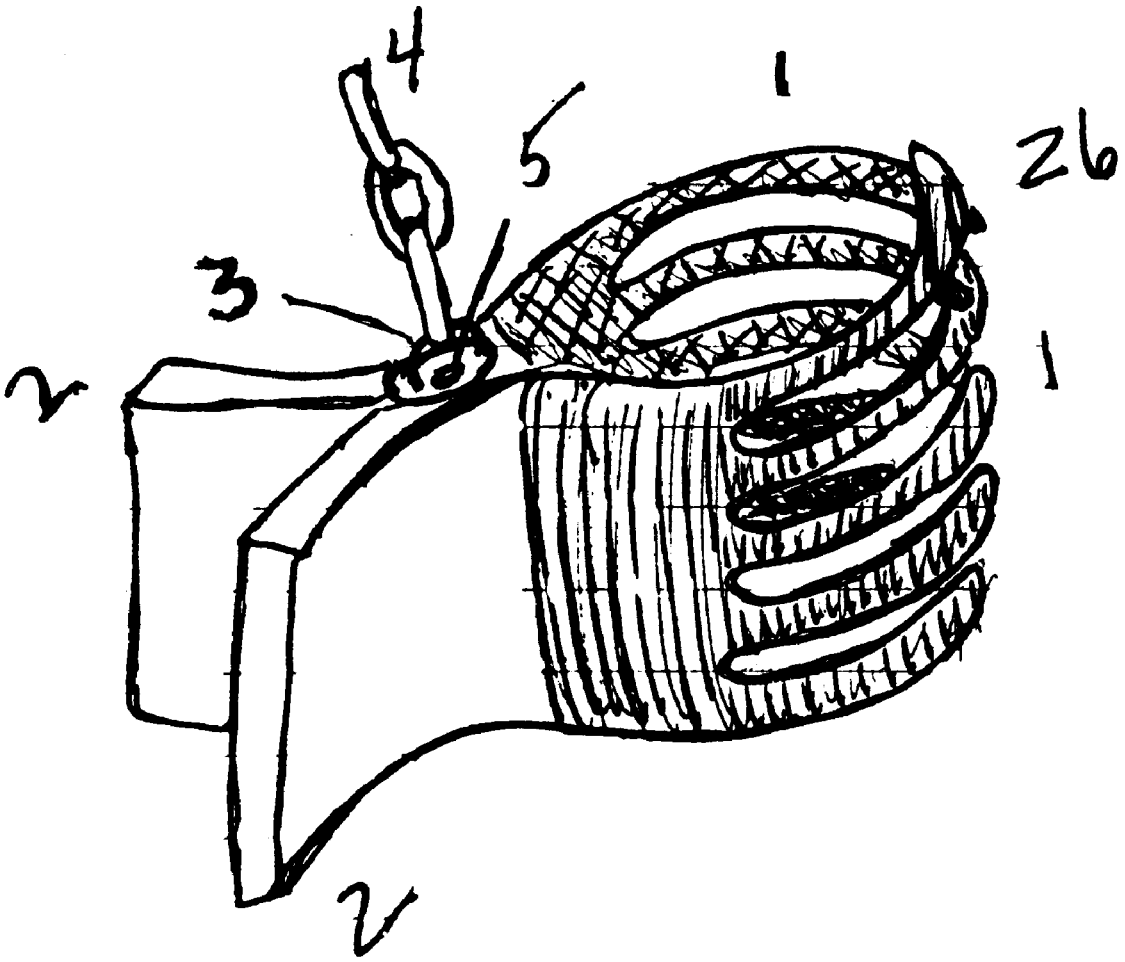
FIG. 20 shows a top-angle perspective view of the self-closing clasp shown in FIGS. 1A through 1D with rubberized coating.

There are various possibilities with regard to the relative disposition of the three elements, the Self-Closing Element, the Connecting Element and the Elongated Element. One embodiment of the Self-Closing Clasp Assembly of the present invention is illustrated in FIG. 1A. In this embodiment, there are two identical self-closing clasps, one in the Self-Closing Element position and one in the Connecting Element position. The self-closing clasps described in this embodiment look like hair clips or clasps found in women's accessory shops, but are designed to be sturdier and capable of grasping around small objects, such as an umbrella, a tool or a towel, or relatively structural or fixed objects, such as a shoulder-bag strap, belt, or part of a baby stroller, depending upon their purpose. The size of the self-closing clasps may vary according to consumer preference and depending on whether they are intended for use as the Connecting Element or the Self-Closing Element. A self-closing clasp intended to be used as the Self-Closing Element is generally sized in the present invention to grasp around an object that is structural or relatively fixed in nature, such as a shoulder-bag strap, belt, or part of a baby stroller. A self-closing clasp intended to be used as the Connecting Element is generally sized and designed in the present invention to be affixed to, in, on, or around a loose, usually smaller, object, such as an umbrella, a tool, or a towel. The Self-Closing Element and the Connecting Element may be the same type of self-closing clasp as long as the self-closing clasp is capable of fulfilling both purposes. As shown in FIG. 1B, the self-closing clasps in the embodiment of the Self-Closing Clasp Assembly shown in FIG. 1A are comprised of five components: two sturdy, yet light, plastic or metal concave-curved interlocking-teeth clasp-halves 1 that are mirror images of themselves, a sturdy fulcrum pin 5, and a sturdy yet flexible metal wire coil with straight extensions 6 that is tightly wound and is flexible enough to allow the ends to be pressed together, and a swivel ring 3. Each concave-curved interlocking-teeth clasp-half 1 has concave-curved teeth at one end, sweeping upward and outward to provide a flat tail 2 at the other end. On each concave-curved interlocking-teeth clasp-half 1, under the area between the concave-curved teeth and the pinch-point tail, comprised of the flat tails 2, is a set of parallel buttressing supports 7 with aligned holes. As shown in FIG. 1C, when the concave-curved interlocking-teeth clasp-halves 1 are fitted together, the concave-curved teeth interlock, the pairs of parallel buttressing supports 7 are aligned and fit snugly together, and the aligned flat tails 2, from the aligned buttressing supports 7, flare upward and outward at angles to each other, forming a pinch-point tail. The flat tails 2 are built on angles of a sufficient degree so that when the clasp-halves are put together, when the flat tails 2 are pinched together, as illustrated in FIG. 1D, the concave-curved interlocking-teeth self-closing clasp may be opened to clasp around either the structural object or the relatively smaller object, depending upon the purpose of the clasp. The concave-curved interlocking-teeth clasp-halves 1 are held together, and are connected to the swivel ring 3, by a fulcrum pin 5. The swivel ring 3 is a washer-type ring that has a flat surface and is sized to fit around a pin or a rod, such as the fulcrum pin 5 in this embodiment, and it is constructed to have a hoop arching over the diameter of the ring. The swivel ring 3 is designed to connect the Self-Closing Element or Connecting Element to the Elongated Element and to allow for less restricted movement among the parts of the Self-Closing Clasp Assembly, as is true in all embodiments in the present invention. The swivel ring 3 sits on top of the buttressing supports 7 so that the hole in the swivel ring 3 is aligned with the aligned holes in the buttressing supports 7. The fulcrum pin 5 is inserted through the swivel ring 3, through the aligned holes in the aligned pairs of parallel buttressing supports 7, and through a wire coil with straight extensions 6 that has been placed in the space between the inside parallel buttressing supports 7. The wire coil with straight extensions 6 sits within the buttressing supports 7 so that the holed through the wire coil is aligned with the holes in the buttressing supports 7. The fulcrum pin 5 is sealed on each end by melting, welding, or bending the ends to prevent the fulcrum pin 5 from slipping out of position. The wire coil with straight extensions 6 is created so that the straight extensions, the short ends of the wire coil that stick out straight, are on opposite sides of the wire coil and press in opposite directions, the directions from which they were coiled. The wire coil with straight extensions 6 is positioned so that the straight extensions are slightly compressed toward each other, and they press against the inside of each of the flat tails 2. This positioning of the straight extensions, and the compression of the straight extensions of the wire coil with straight extensions 6 when it is placed within the buttressing supports 7, creates tension in the self-closing clasp by forcing the flat tails 7 apart, thereby allowing the self-closing clasp to remain closed when in the resting state. As shown in FIG. 1D, the concave-curved interlocking-teeth clasp opens when pressure from fingers 27 is applied to the flat tails 2, squeezing them together. The Self-Closing Element and the Connecting Element, through connection to the swivel rings 3 at the base of each, are linked to the rigid or flexible Elongated Element, in this embodiment, a chain 4. They are linked to the Elongated Element in the same manner that the chain links are connected, by bending and either welding or compressing the ends of each interconnected link in the chain together to form interlocking rings. In other embodiments, the self-closing clasps may also benefit from a rubber coating 26 such as that on the teeth of the concave-curved, interlocking-teeth clasp-halves 1, illustrated in FIG. 20, to provide a non-slip surface.

Figure 2A:
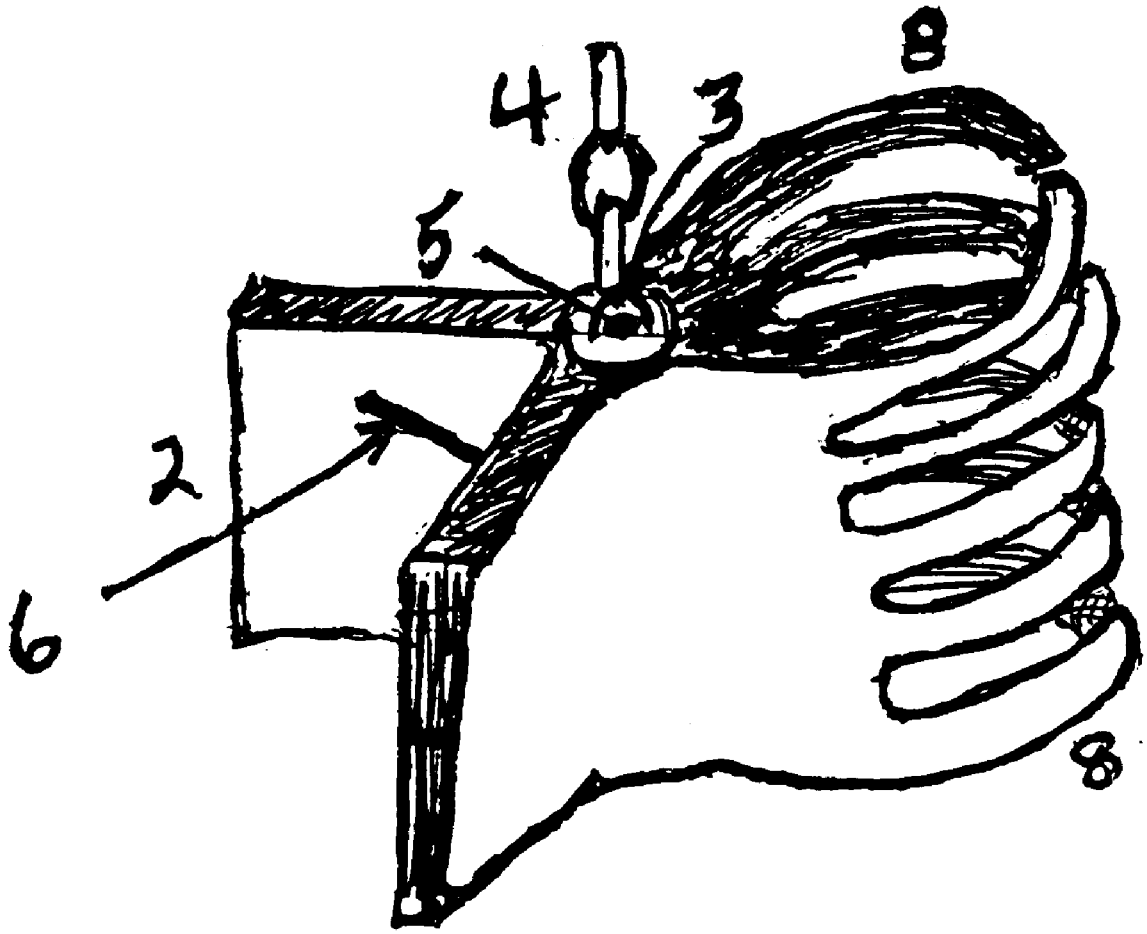
FIG. 2A shows a top perspective view of a variation of a self-closing clasp having concave-curved opposing (rather than interlocking) teeth that can be used in the Self-Closing Clasp Assemblies of the present invention.
Figure 2B:
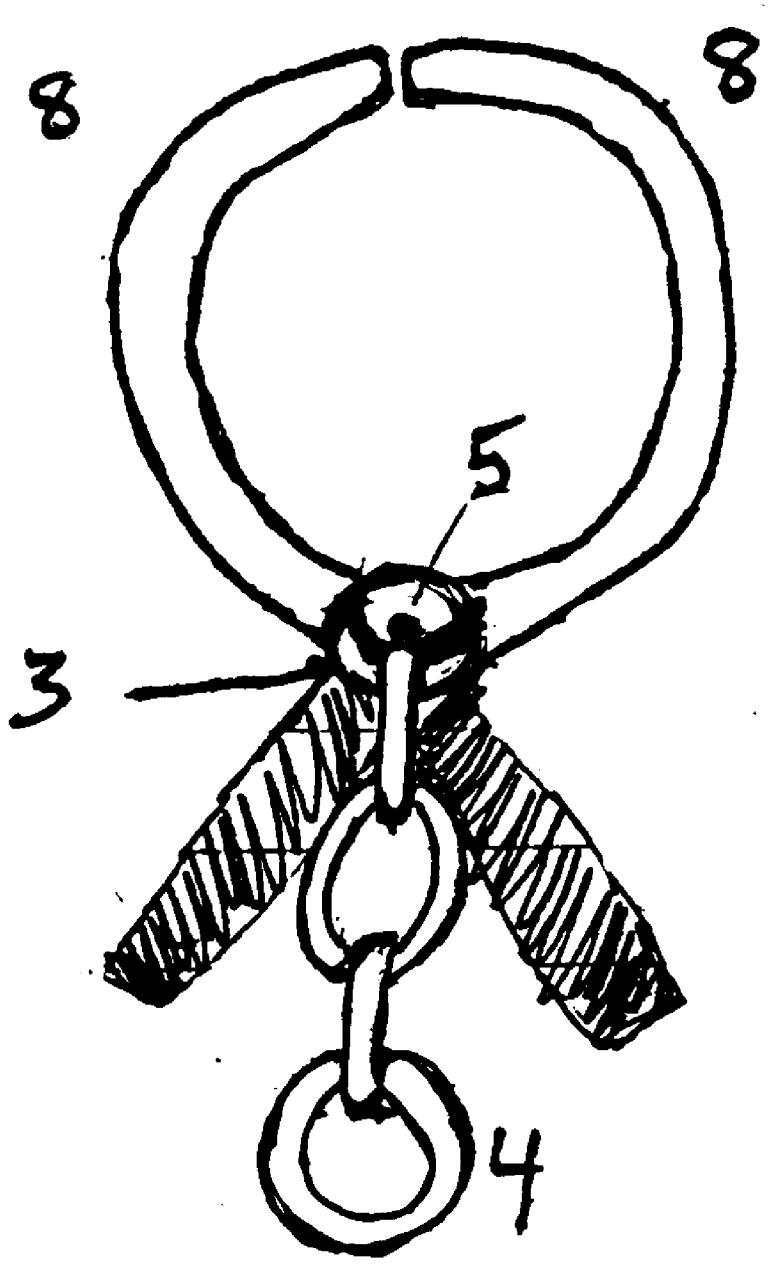
FIG. 2B shows a top view of the concave-curved self-closing clasp with opposing-teeth shown in FIG. 2A, as it attaches to an Elongated Element.
Figure 3A:
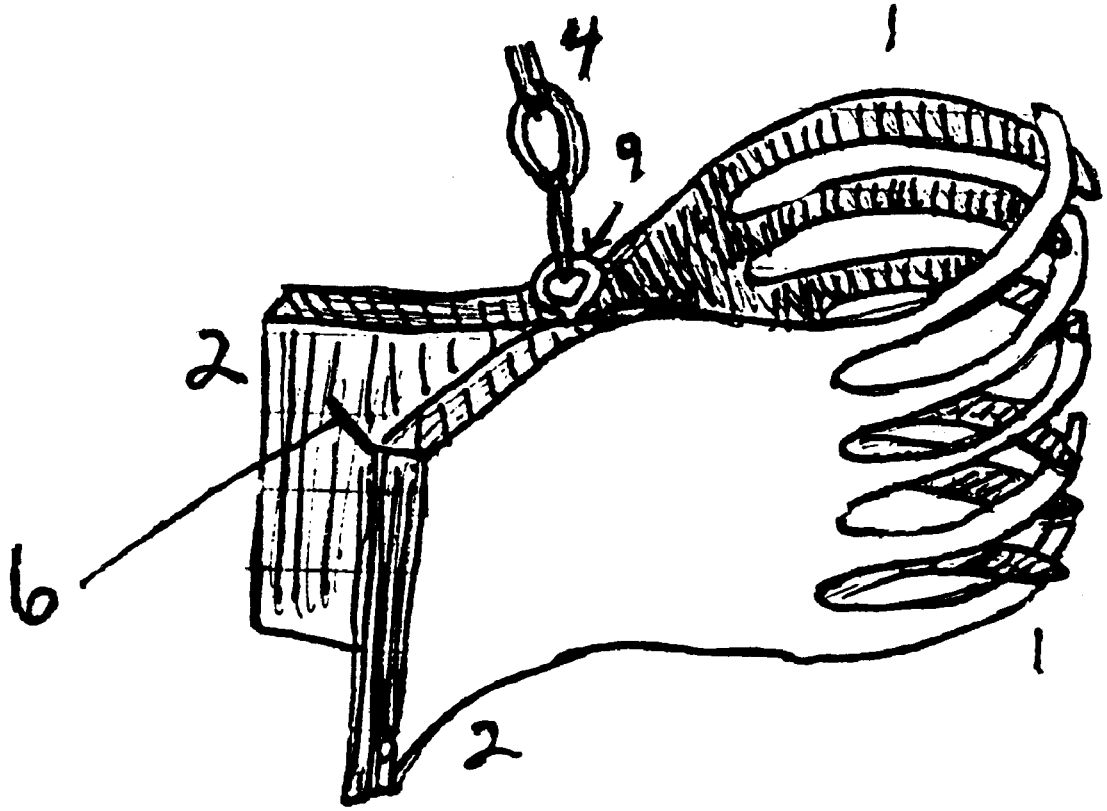
FIG. 3A shows a top perspective view of a variation of a self-closing clasp having a fulcrum pin with a ring on one end, for attachment to an Elongated Element, that can be used in the Self-Closing Clasp Assemblies of the present invention.
Figure 3B:
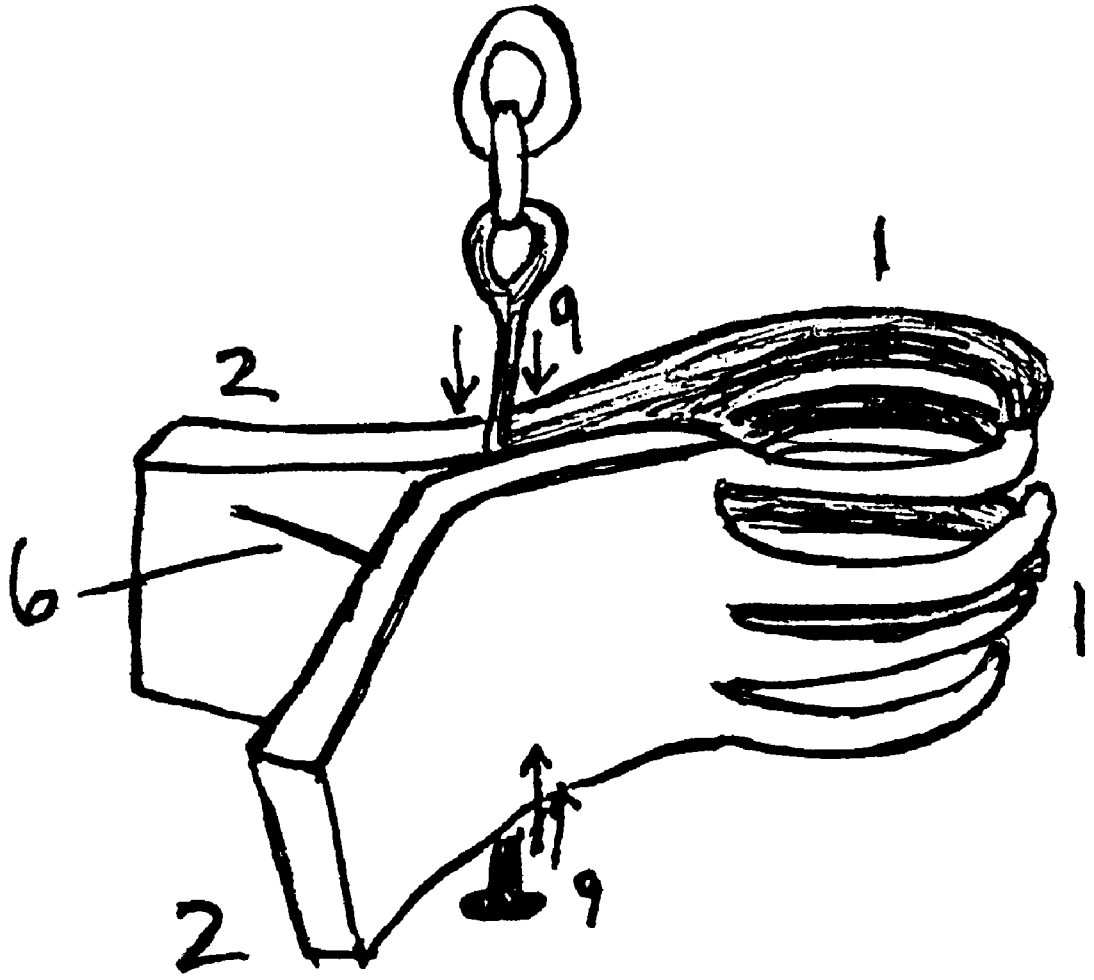
FIG. 3B shows a top perspective view of the self-closing clasp with fulcrum pin and ring shown in FIG. 3A, illustrating how the fulcrum pin with ring fits in the clasp.
Figure 3C:
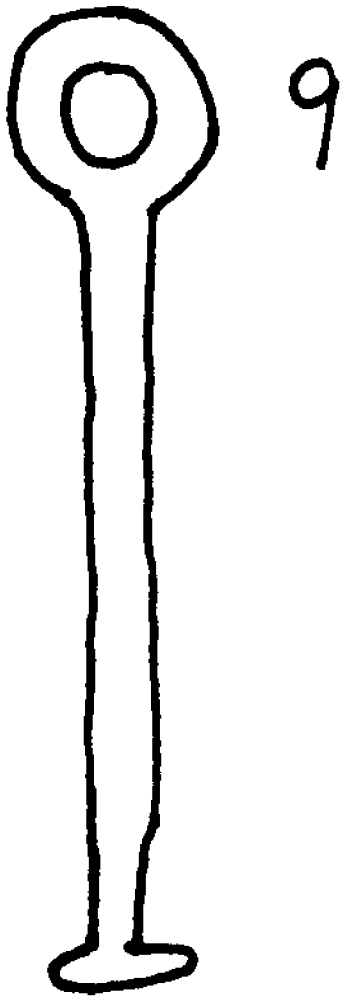
FIG. 3C shows a side plan view of the fulcrum pin with ring shown in FIG. 1A.

Additional embodiments are shown in FIGS. 2 and 3, which show variations of the self-closing clasps that may be used in either the Self-Closing Element or Connecting Element positions, are made of similar materials and that operate, are generally constructed, are sized, and connect to the Elongated Element in a manner similar to that described in FIGS. 1A through 1D, but that are modified to meet user need. FIGS. 2A and 2B illustrate a self-closing clasp in which the tips of the concave-curved, self-closing clasp-halves with opposing-teeth 8 meet when assembled and in the resting state. FIGS. 3A through 3C illustrate a variation of a self-closing clasp in which the concave-curved interlocking-teeth clasp is held together and is attached to the chain 4 by a fulcrum pin with a ring on one end 9. Variations of these self-closing clasps are used as hair accessories. The difference in purpose, construction, and sizing between the variations described in this embodiment and the variations used as hair accessories are similar to those described in FIGS. 1A through 1D.

Figure 4A:
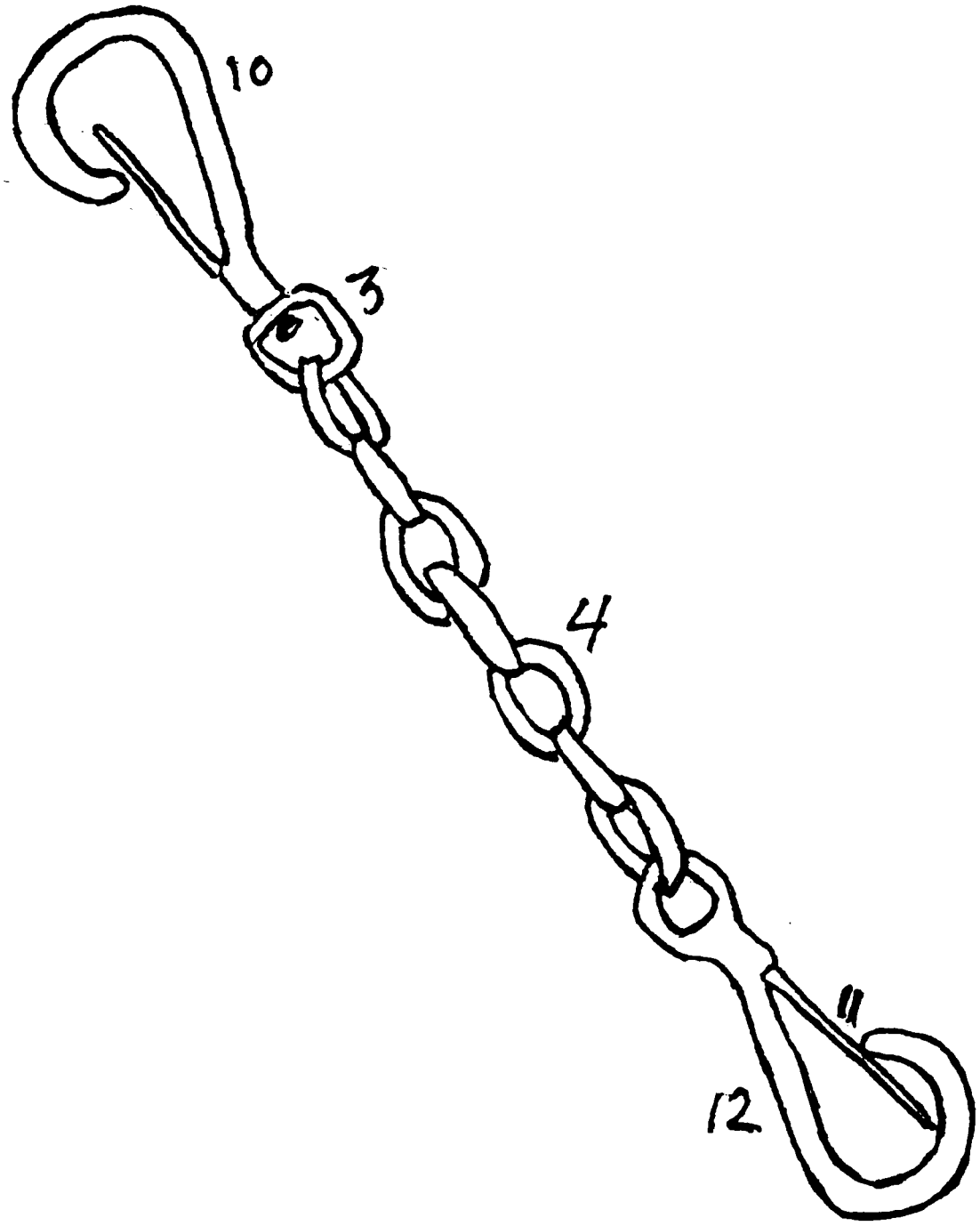
FIG. 4A shows a side plan view of the Self-Closing Clasp Assembly of the present invention wherein, the Connecting Element is comprised of a "D-Ring" with Ring Base and the Self-Closing Element is comprised of a "D-Ring" with Rod Base.
Figure 4B:
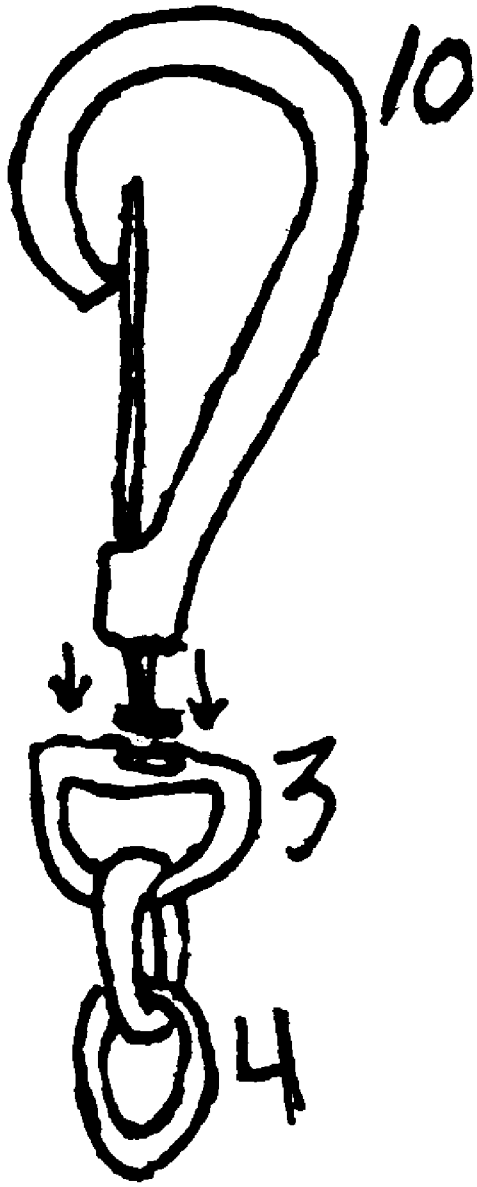
FIG. 4B is a side plan view of the Unit "D-Ring" with Rod Base shown in FIG. 4A, as it fits with a swivel ring and Elongated Element.
Figure 4C:
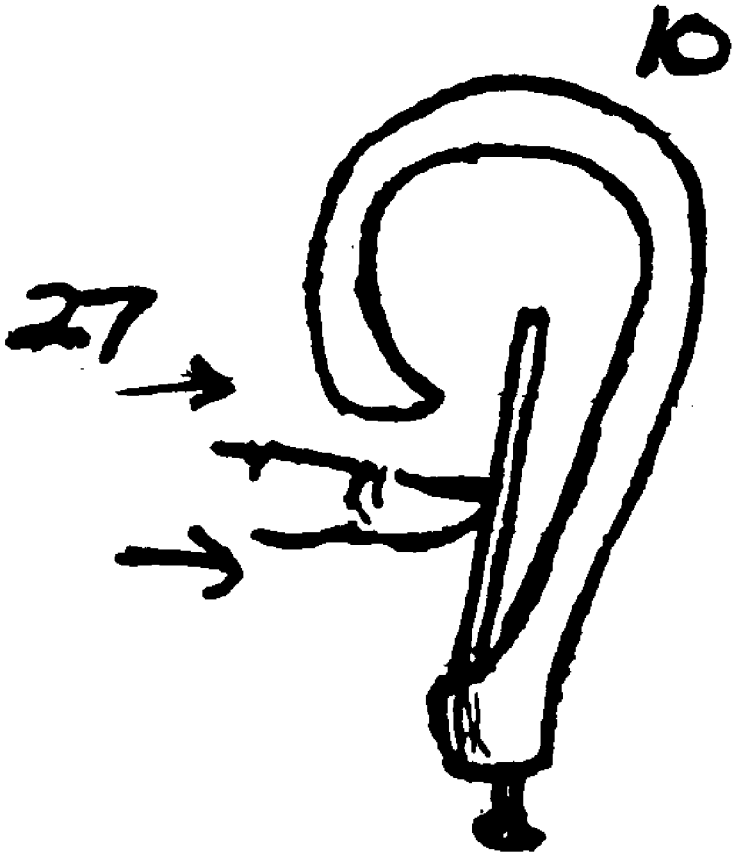
FIG. 4C is a side plan view of the Unit "D-Ring" with Rod Base shown in FIG. 4A as pressure is applied to open it.
Figure 4D:
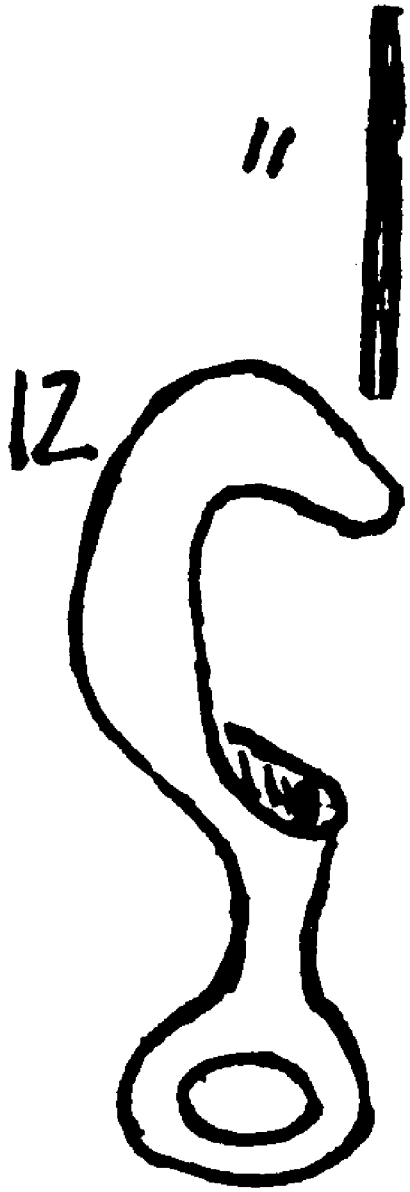
FIG. 4D is a side perspective view of the "D-Ring" with Ring Base shown in FIG. 4A, as the separate entry valve fits into the "D-Ring".
Figure 4E:
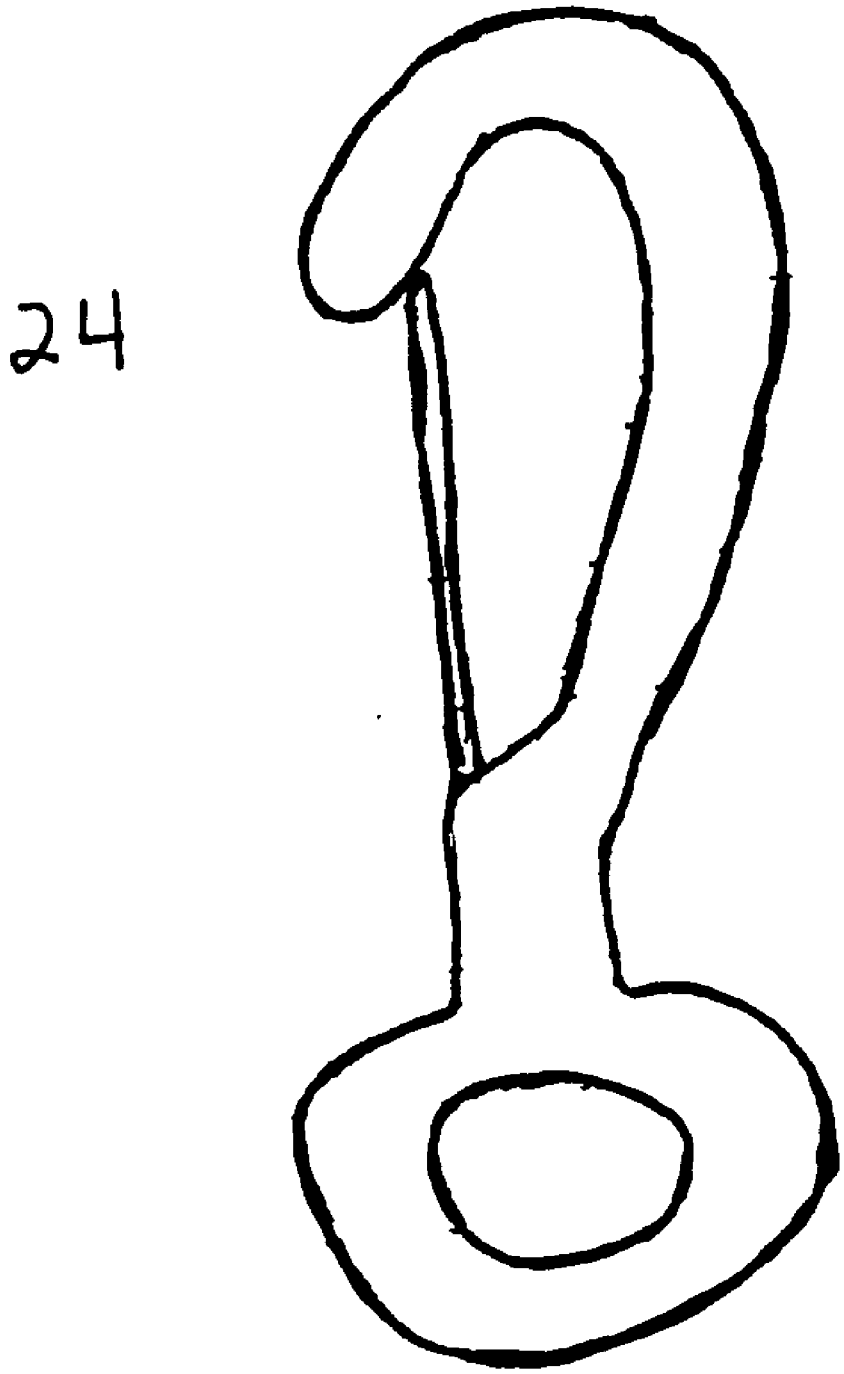
FIG. 4E is a side view of a variation of the Unit "D-Ring" with Ring Base shown in FIG. 4A.

There are various possibilities with regard to the relative disposition of the Self-Closing Element, the Connecting Element or the Elongated Element. Another embodiment of the Self-Closing Clasp Assembly is shown in FIGS. 4A through 4E, where self-closing clasps are used in both the Self-Closing Element and Connecting Element positions, which may be used interchangeably, and are in the form of "D-Ring" self-closing clasps. Variations of the self-closing "D-Ring" clasps described in this embodiment are sometimes used to attach dog chains to dog collars or as closures on shoulder bags. These "D-Ring" self-closing clasps connected to the Elongated Element in a manner similar to that described in FIGS. 1A through 1D. As shown in FIG. 4A, the "D-Ring" in the Self-Closing Element position is preferably a Unit "D-Ring" with a Rod Base 10, with a swivel ring 3 around the rod. As shown in FIG. 4B, the Unit "D-Ring" with Rod Base 10 is a single piece that is shaped like a hook, with a straight, thin piece acting as an entry valve jutting upward from the top of the base of the hook to press against the inside of the top of the hook, and with a rod emanating out of the bottom of the base. The top of the hook is created to curve and extend to a point at which the top of entry valve is forced against the inside of the top of the hook with pressure when the "Unit D-Ring" with Rod Base 10 is in a state of rest. A swivel ring 3 is placed around the rod in a manner and with a purpose and function similar to that described in FIGS. 1A through 1D. As shown in FIG. 4C, the entry valve opens by applying pressure to it, such as when a finger 27 pushes against the entry valve, away from the inside of the top of the hook. Another variation of the "D-Ring" self-closing clasp in this embodiment, the "D-Ring" with Ring Base, is in the Connecting Element position, as shown in FIG. 4A. As illustrated in FIG. 4D, "D-Ring" self-closing clasp is comprised of two pieces, a "D-Ring" hook with Ring Base 12 and an entry valve 11, which is a separate straight, thin piece that is inserted into the base so that it fits firmly against the inside of the top of the hook with pressure in a state of rest, in a manner similar to that described for the Unit "D-Ring". The entry valve 11 is held in place in the top of the base of the hook by methods such as forcing the entry valve 11 into a relatively smaller hole in the top of the base, relying on the surrounding pressure for stability, or by gluing, welding, or compressing the base around the entry valve 11. The entry valve 11 is sized, positioned, and operated in a manner similar to the entry valve described in FIG. 4C. The Unit "D-Ring" with Ring Base 24 is another variation of the self-closing clasp that may be constructed as shown in FIG. 4E which operates in a similar manner to the embodiments described in FIGS. 4A through 4D. These self-closing clasps are adaptable, depending upon user need or preference.

Figure 5A:
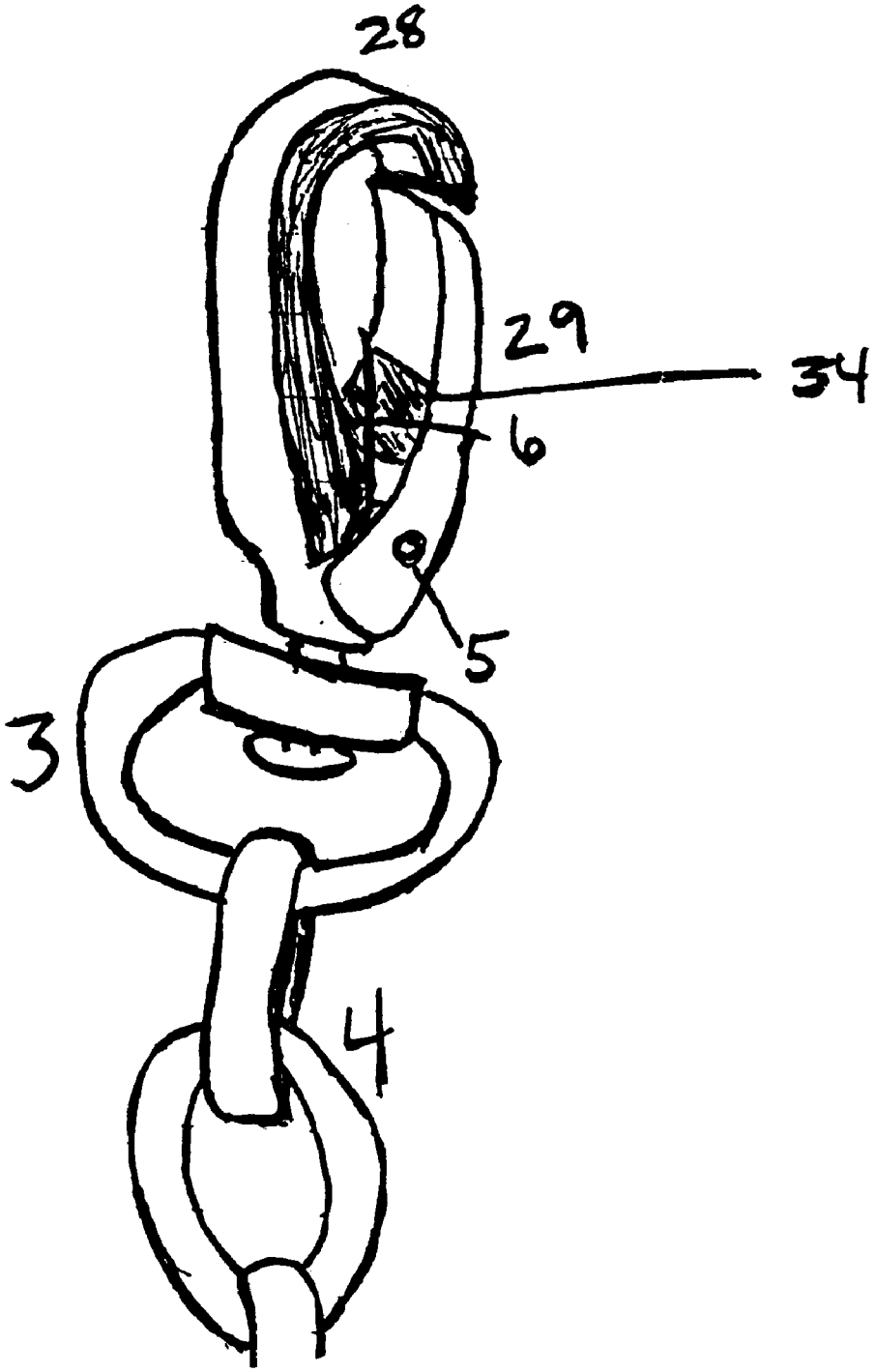
FIG. 5A is a rear perspective view of a variation of the self-closing clasp useful in the Self-Closing Clasp Assemblies of the present invention having a Hinged Entry-Valve "D-Ring" as it connects to the Elongated Element.
Figure 5B:
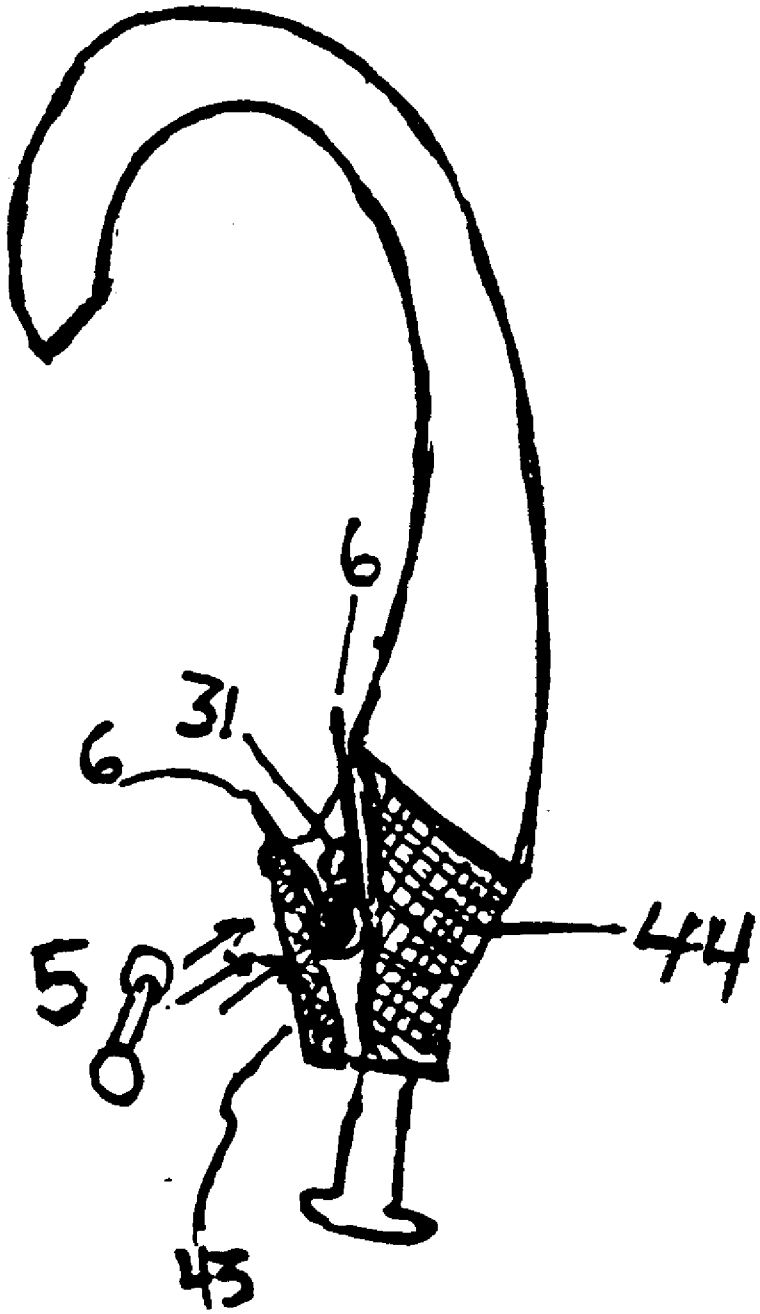
FIG. 5B is a side perspective view of the Hinged Entry-Valve "D-Ring" hook shown in FIG. 5A as it fits with the wire coil with extensions and fulcrum pin.
Figure 5C:
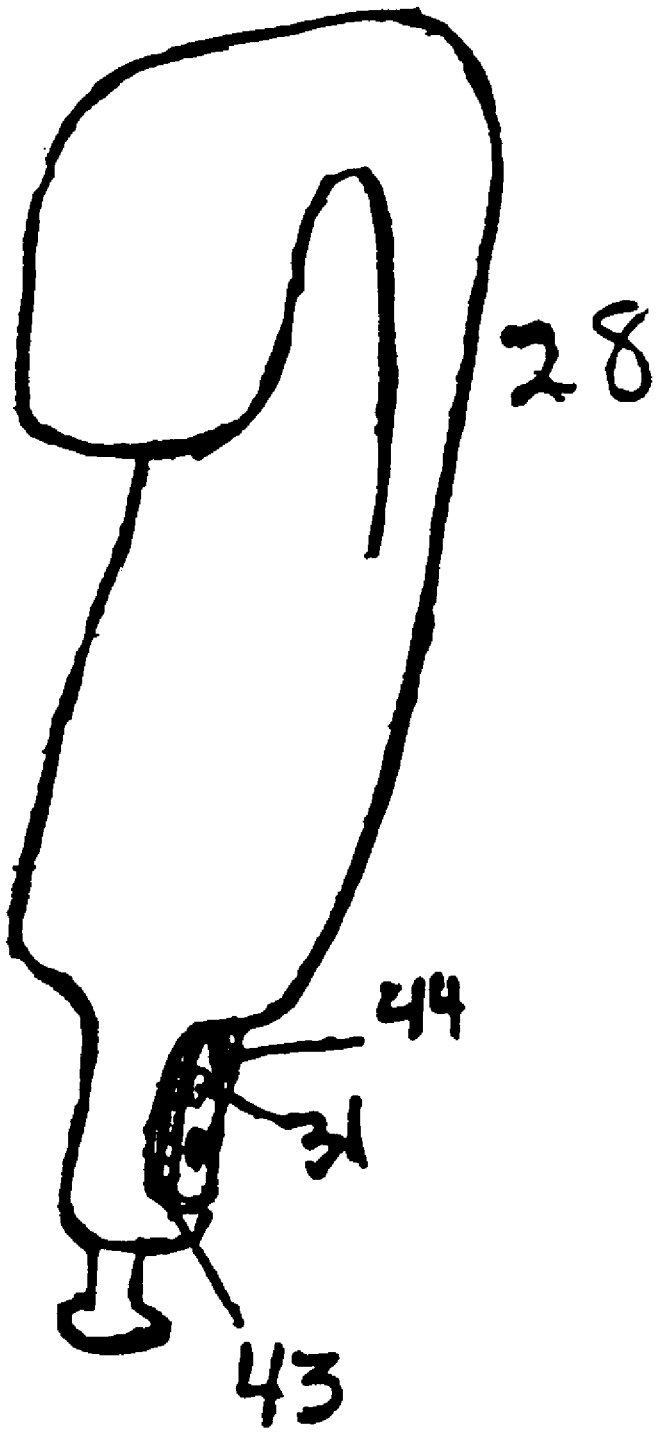
FIG. 5C is a front perspective view of the Hinged Entry-Valve "D-Ring" hook shown in FIG. 5A.
Figure 5D:
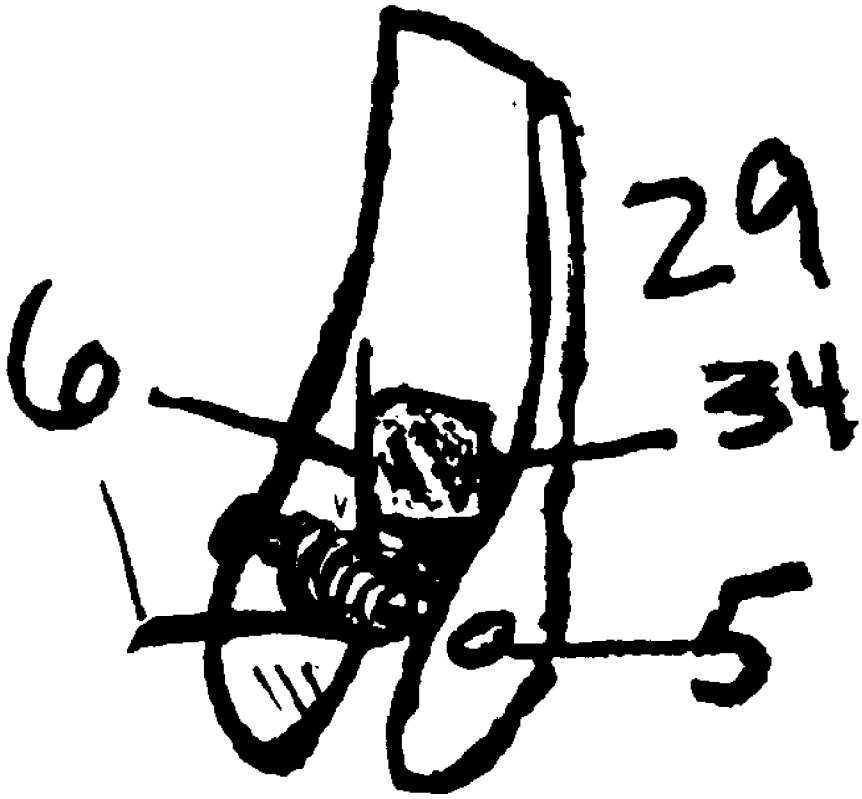
FIG. 5D is a rear perspective view of the Hinged Entry-Valve shown in FIG. 5A as it fits with wire coil with straight extensions and fulcrum pin.
Figure 5E:
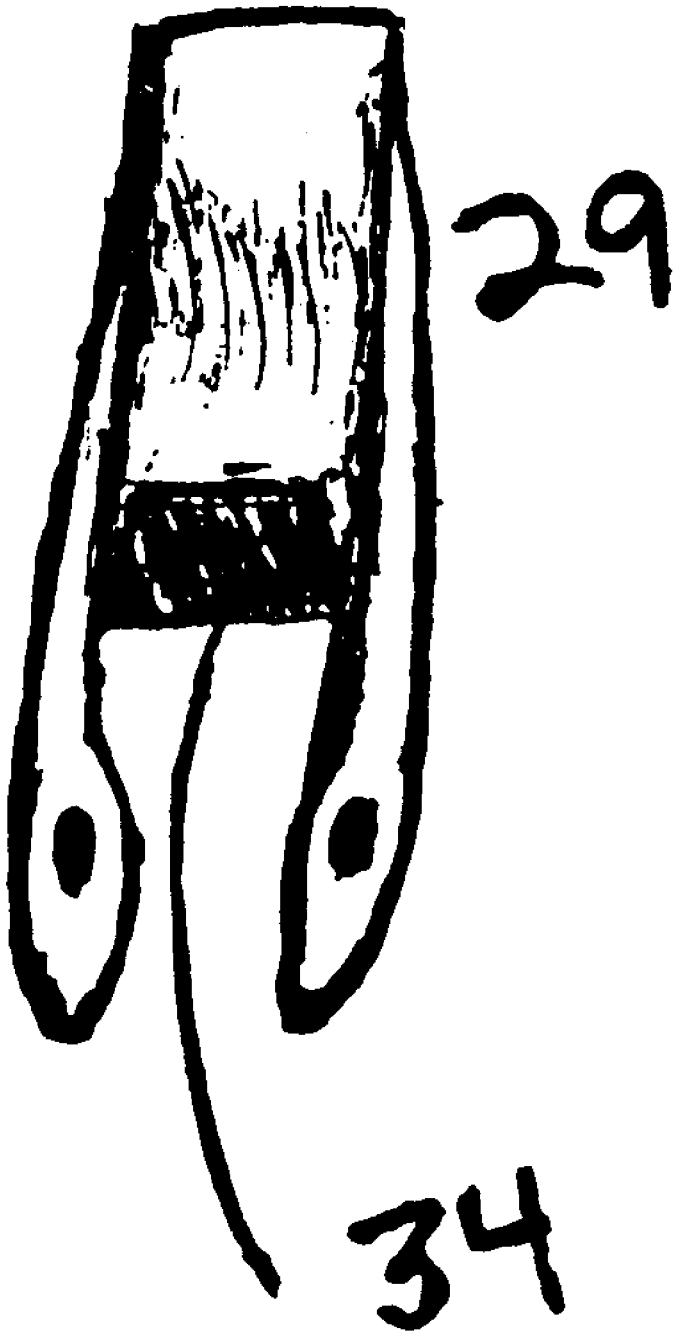
FIG. 5E is a rear perspective view of the Hinged-Entry Valve shown in FIG. 5A.
Figure 5F:
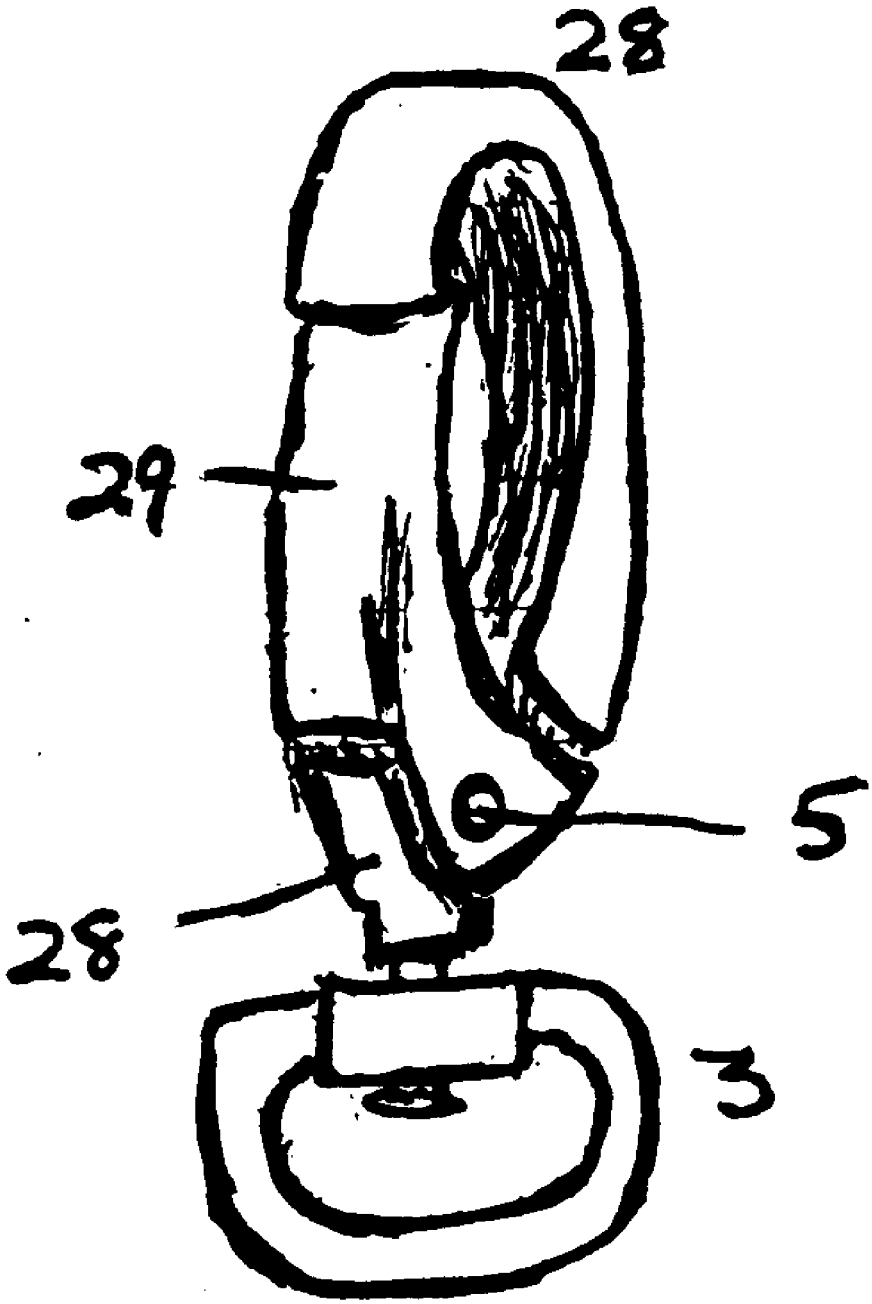
FIG. 5F is a front perspective view of the Hinged-Entry Valve "D-Ring" shown in FIG. 5A.

Another embodiment of the present invention can be seen in FIGS. 5A through 5F, which illustrate a type of the self-closing clasp that may be used in either the Self-Closing Element or Connecting Element position. It is made of materials and is connected to the Elongated Element in a manner similar to that described in FIGS. 1A through 1D and operates and is sized in a similar manner to that described in FIGS. 4A–4E, but is modified to meet user need. Variations of the type of self-closing clasp described in this embodiment may be found in handbag closures or strap attachments. The sizing, construction, and purpose differ in a manner that is similar to that described in FIGS. 1A through 1D. As seen in FIG. 5A, the self-closing clasp is a Hinged-Entry Valve "D-Ring", and is comprised of a Hinged-Entry Valve "D-Ring" Hook 28, a Hinged-Entry Valve 29, a swivel ring 3, a fulcrum pin 5, and a wire coil with straight extensions 6. As shown in FIG. 5B, the Hinged-Entry Valve "D-Ring" Hook 28 is in the shape of a hook that curves downward from the top to a base. The inside-edge of the top of the hook is at an angle. As shown in FIG. 5C, two sides of the area below the hook indent to form a narrowed base. Under this base extends a rod with a head, and around which is placed a swivel ring 3, as shown in FIG. 5A, in a manner and with a purpose and function similar to that described in FIGS. 1A through 1D. As shown in FIG. 5B, a hole goes through the narrowed sides of the base. Near the bottom of one of the narrowed sides of the base, is a further indentation that is bordered by a narrow ridge 43 that extends from the bottom of the base up to the inside of the bottom of the hook, on the side in which direction the hook points. On the same narrowed side is a knob 31 that is located directly above the hole. To the side of the knob 31 and the hole, away from the narrow ridge 43, is a space which is the last portion of the further indented area. This space is bordered by an area that is on a slightly raised level 44, which is the level of the original indentation of the narrowed sides. The height of this slightly raised level 44 is the same as that of the narrow ridge 43. The other narrowed side of the base is one level surface, with the exception of the hole through the center. As shown in FIGS. 5A and 5D, the Hinged-Entry Valve 29 is a piece with an angled top, that is slightly curved, and that has sides which gradually widen to form two parallel buttresses extending down from the sides of the piece, leaving an empty space between the buttresses, as illustrated in FIG. 5E. The center of the rear-side of the Hinged-Entry Valve 29, directly above the empty space, slopes back to allow for clasp movement when it is fully assembled, as shown in FIGS. 5D and 5E. There is a hole in each buttress, and the holes are aligned. As shown in FIG. 5A, the Hinged-Entry Valve 29 is constructed so that when it is assembled with the Hinged-Entry Valve "D-Ring". Hook 28, the buttresses fit on either side of the base of the Hinged-Entry Valve "D-Ring" Hook 28, and all of the holes are aligned. The angled top of the Hinged-Entry Valve 29 meets against the angled top of the Hinged-Entry Valve "D-Ring" Hook 28, so that they meet in a flush manner. As shown in FIGS. 5A and 5B, this self-closing clasp is held together by a fulcrum pin 5 which passes through the aligned holes in the base of the Hinged-Entry Valve 29, the aligned holes in the base of the Hinged-Entry Valve "D-Ring" Hook 28, and through a wire coil with straight extensions 6 that has been placed inside the base of the Hinged-Entry Valve "D-Ring" Hook 28 so that the hole through the wire coil is aligned with the holes in the base. The fulcrum pin 5 and the wire coil with straight extensions 6 are created, positioned, and operated in a manner similar to that described in FIGS. 1A through 1D. As shown in FIG. 5B, one of the straight extensions of the wire coil 6 is positioned so that it sits in the further indentation in the narrowed side of the base of the Hinged-Entry Valve "D-Ring" Hook 28. This straight extension is bordered and held in place by the narrow ridge 43. The top of the straight extension presses against the sloped area 34 of the Hinged-Entry Valve 29. The other extension passes through the space between the knob 31 and the slightly raised level 44 and presses against the Hinged-Entry Valve "D-Ring" Hook 28. This embodiment demonstrates the ability to adapt the Self-Closing Clasp Assembly to meet individual needs and preferences.

Figure 6:
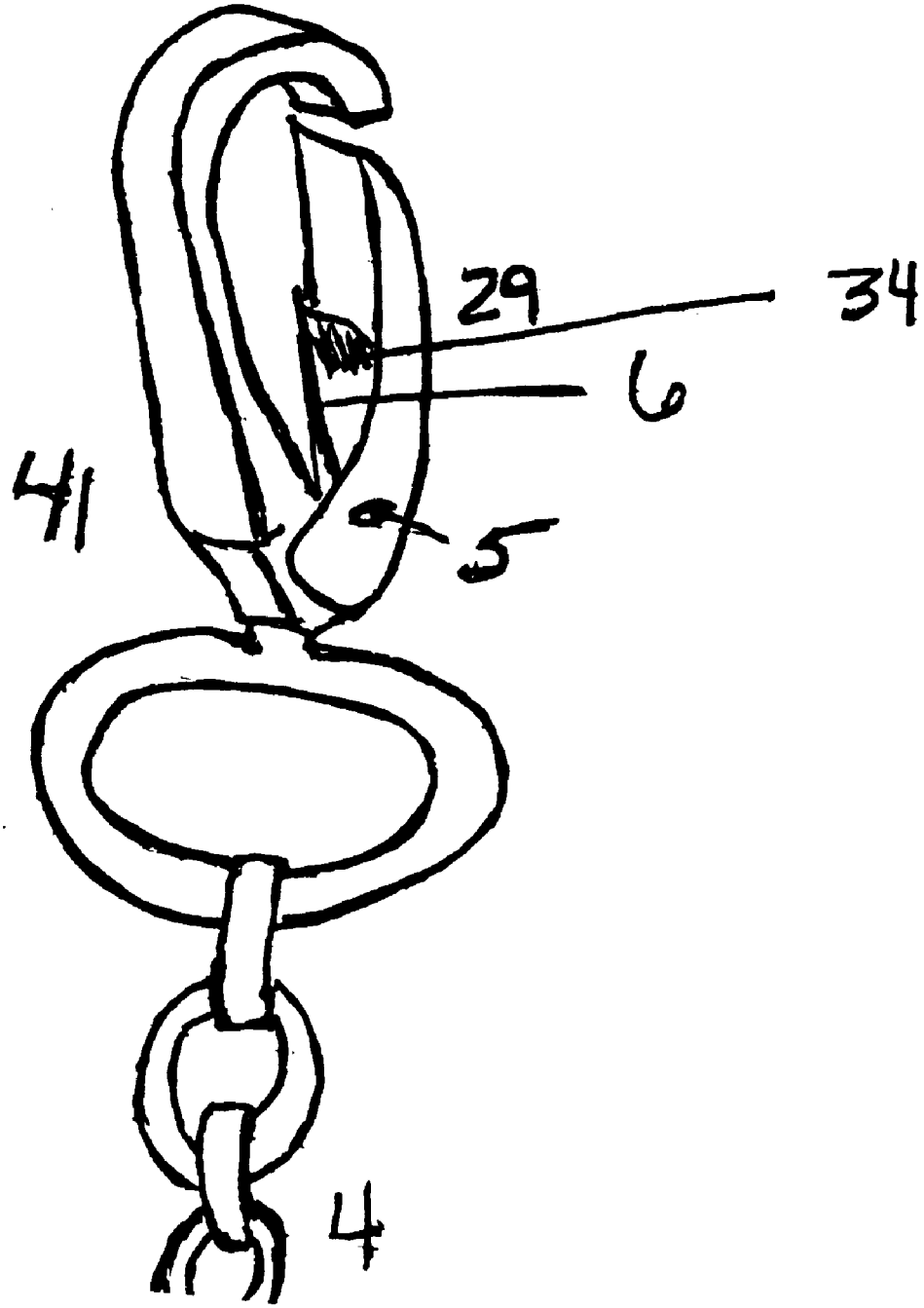
FIG. 6 is a rear perspective view of a self-closing clasp useful in the Self-Closing Clasp Assemblies of the present invention, having a Hinged-Entry Valve "D-Ring" with Ring Base.

Another type of self-closing clasp that may be used in either the Self-Closing Element or Connecting Element position is shown in FIG. 6, which shows a Hinged-Entry Valve "D-Ring" with Ring Base. This embodiment is made of materials, is sized, and connects to the Elongated Element in a manner similar to that described in FIGS. 1A through 1D and is constructed and operates in a similar manner to that described in FIGS. 5A–5F, but that is modified to meet user need. Variations of the type of self-closing clasp described in this embodiment may be found in handbag closures or strap attachments. The sizing, construction, and purpose differ in a manner that is similar to that described in FIGS. 1A through 1D. As illustrated in FIG. 6, the Hinged-Entry Valve "D-Ring" Hook with Ring Base 41 may be constructed to connect the clasp to the Elongated Element, a chain 4 in this embodiment.

Figure 7A:
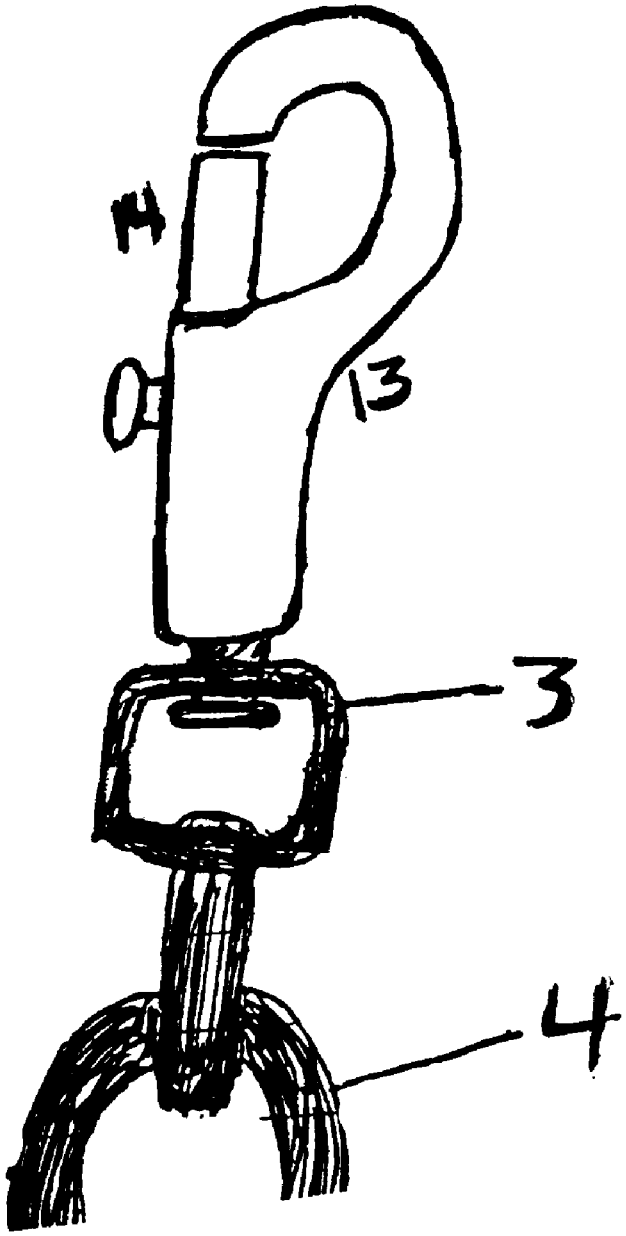
FIG. 7A is a side perspective view of a self-closing clasp useful in the Self-Closing Clasp Assemblies of the present invention having a Thumb-Slide Entry-Valve "D-Ring" as it attaches to the Elongated Element.
Figure 7B:
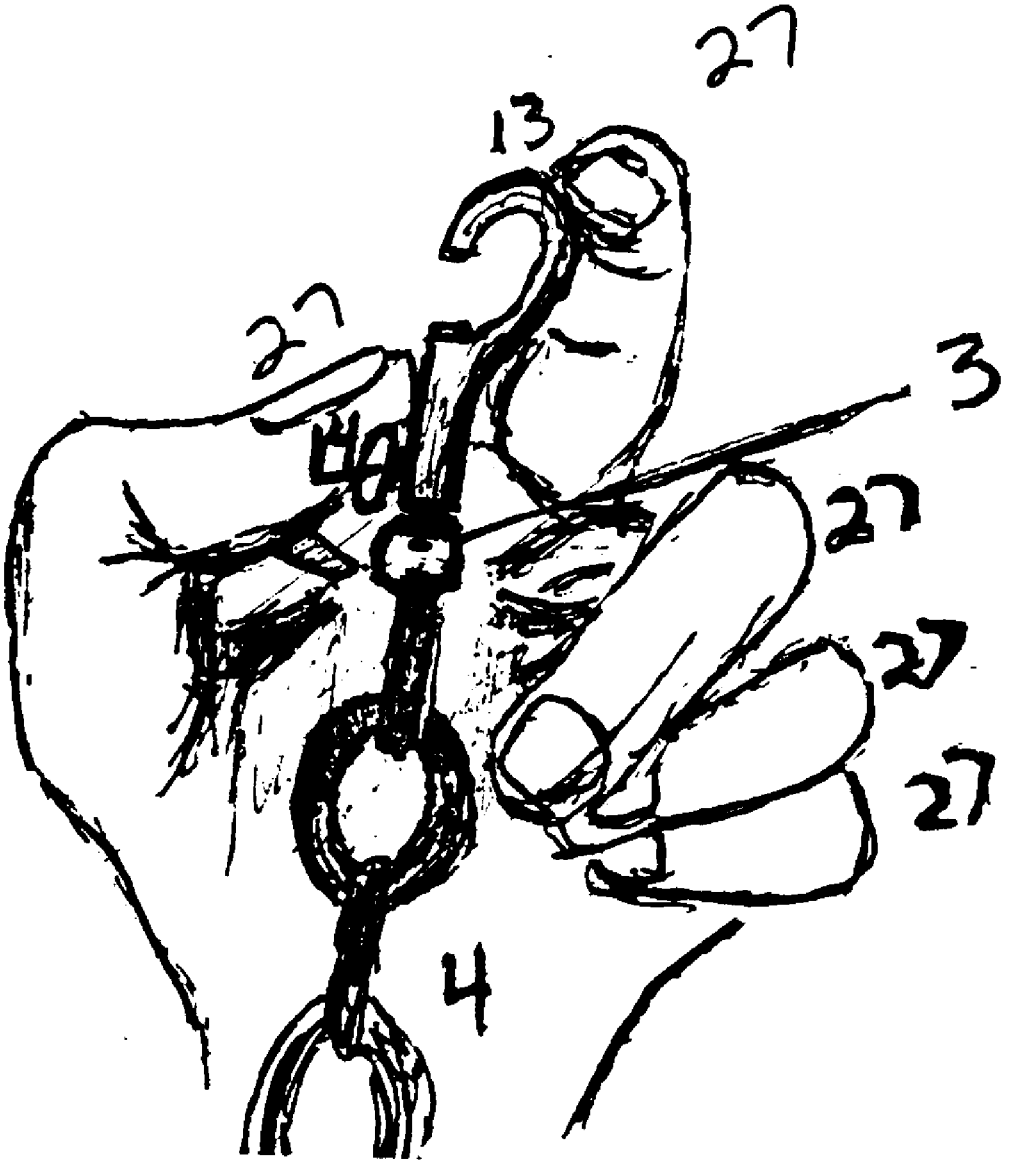
FIG. 7B is a side perspective view of the Thumb-Slide Entry-Valve "D-Ring" shown in FIG. 7A as it is being opened.
Figure 7C:
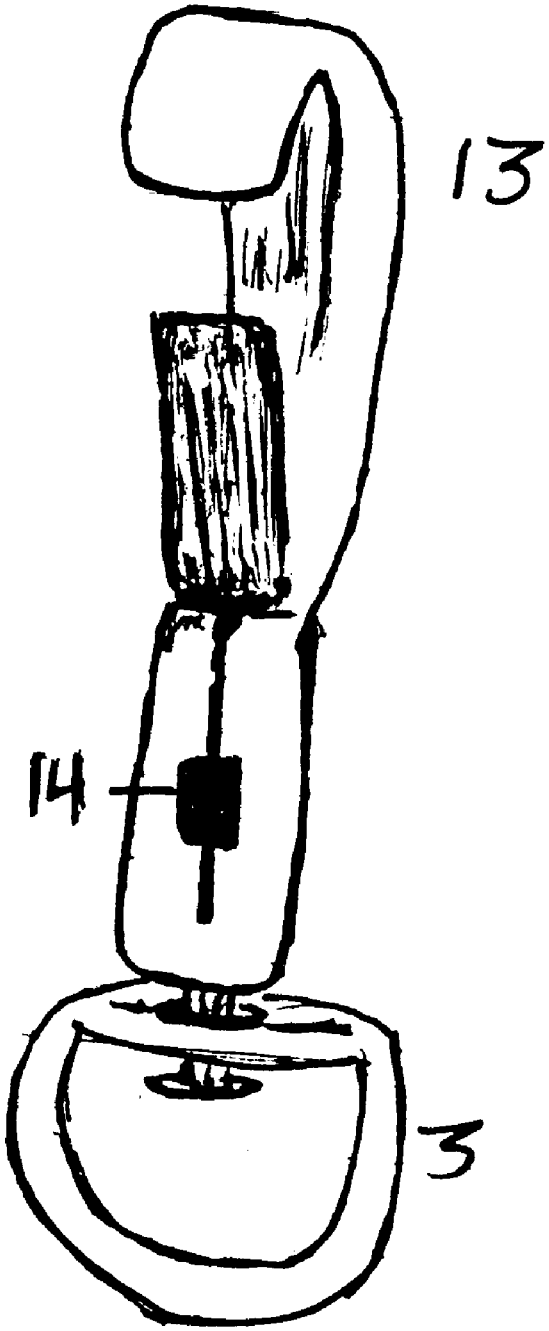
FIG. 7C is a front perspective view of the Thumb-Slide Entry-Valve "D-Ring" shown in FIG. 7A in the open position.
Figure 7D:
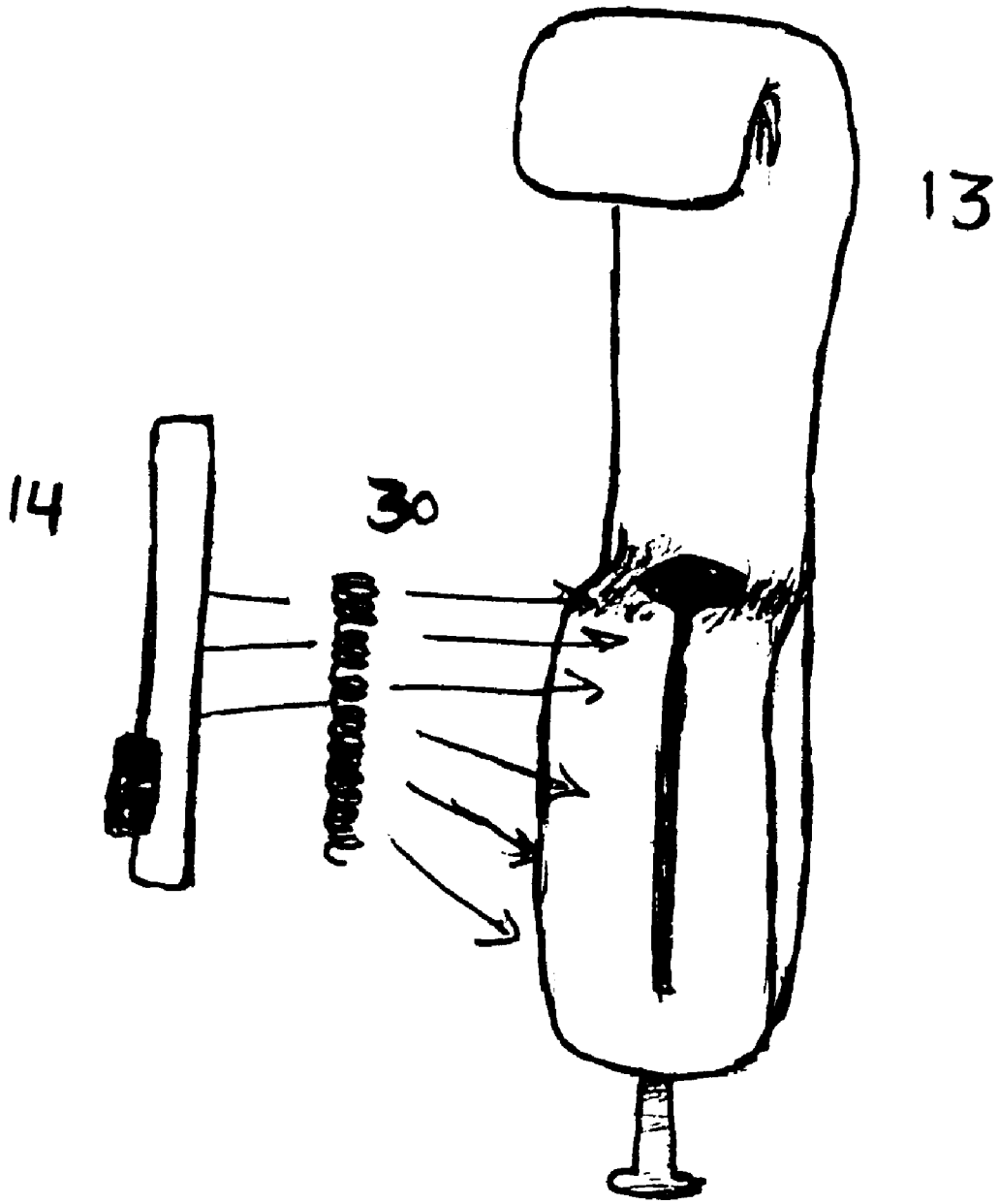
FIG. 7D shows a front perspective view of the Thumb-Slide Entry-Valve "D-Ring" hook shown in FIG. 7A and wire coil.
Figure 7E:
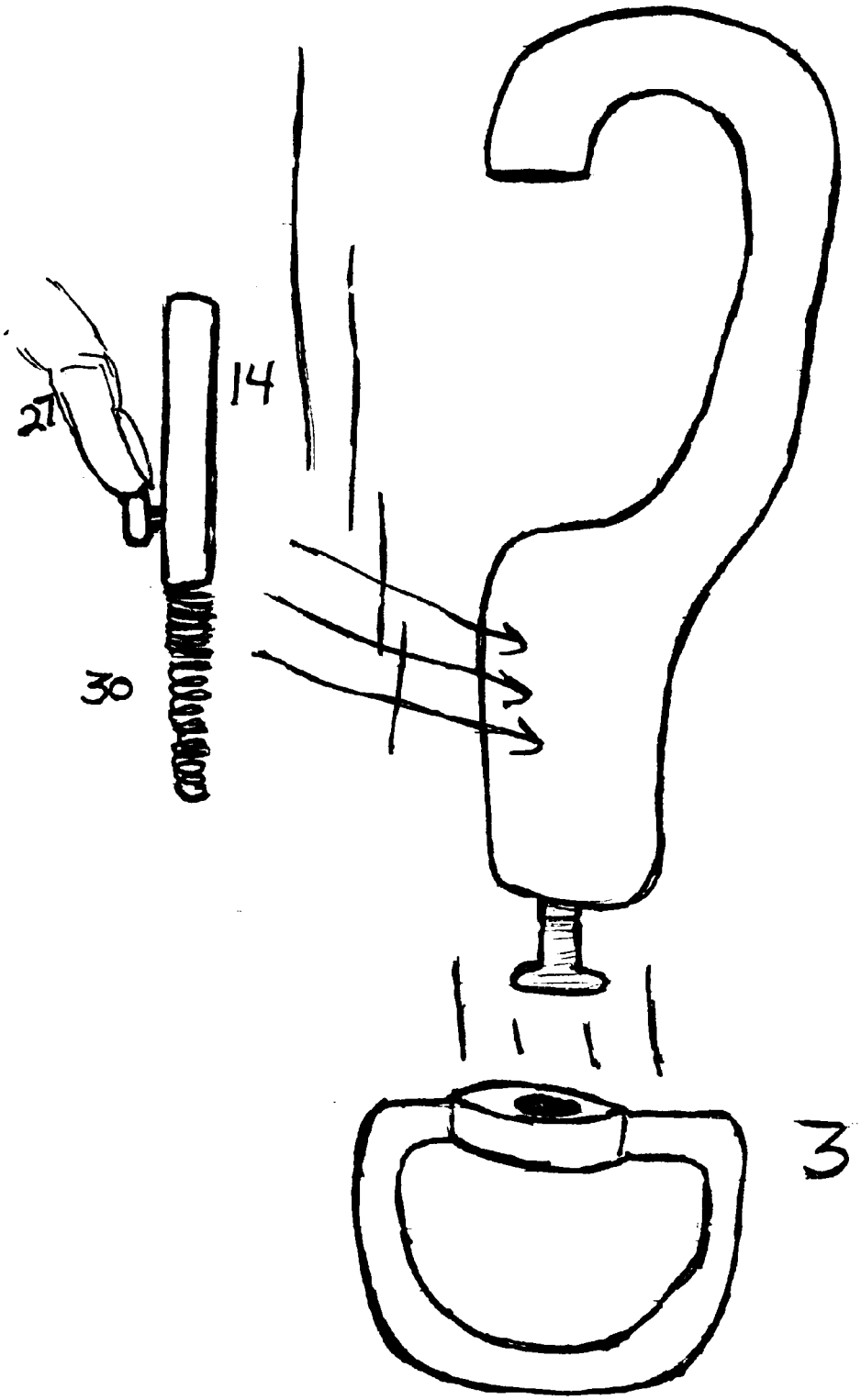
FIG. 7E shows a side perspective view of the Thumb-Slide Entry-Valve "D-Ring shown in FIG. 7A with its component parts.

A further embodiment of the invention is illustrated in FIGS. 7A through 7E, which show a variation of the self-closing clasp that may be used in either the Self-Closing Element or Connecting Element position, and that is made of materials and connects to the Elongated Element in a manner similar to that described in FIGS. 1A through 1D, but that is modified to meet user need. Variations of the type of self-closing clasp described in this embodiment may be found used to attach chains or partitioning cords, such as those found to direct traffic through theater or airline ticket lines, to rings on posts. The sizing, construction, and purpose differ in a manner that is similar to that described in FIGS. 1A through 1D. FIG. 7A illustrates a Thumb-Slide Entry-Valve "D-Ring" clasp. As shown in FIG. 7D, the Thumb-Slide Entry Valve "D-Ring" clasp is comprised of a Thumb-Slide Entry-Valve 14, the Thumb-Slide Entry-Valve "D-Ring" Hook 13, a wire coil 30, and swivel ring 3. The Thumb-Slide Entry-Valve "D-Ring" Hook 13 is in a shepherd's crook shape with a hollow, tube-like base with a slit along the top part of the front of the base. Inside the hollow base, sits a wire coil 30 which is made of a sturdy, yet flexible metal wire that is coiled so that there is space between each coil, allowing the wire coil 30 to be compressed. As shown in FIG. 7E, sitting on top of the wire coil 30 and slightly compressing the wire coil 30, is the Thumb-Slide Entry-Valve 14, which is a thin bar, fitted to slide with ease inside the hollow, tube-like base of the Thumb-Slide Entry-Valve "D-Ring" Hook 13. Protruding from the center of the Thumb-Slide Entry-Valve 14 is a knob 31 which remains outside the hollow, tube-like base of the Thumb-Slide Entry-Valve "D-Ring" Hook 13 when the Thumb-Slide Entry-Valve 30 is inserted into the hollow base. In a state of rest, the top of the Thumb-Slide Entry-Valve is pressed firmly against the top of the Thumb-Slide Entry-Valve "D-Ring" Hook 13 due to the slightly compressed wire coil 30, allowing the self-closing, Thumb-Slide Entry-Valve "D-Ring" clasp to remain closed. As shown in FIGS. 7B and 7E, by applying downward pressure to the thumb-slide, the wire coil 30 further compresses, allowing entry to the Thumb-Slide Entry-Valve "D-Ring" clasp, which is sized to grasp in a manner similar to the self-closing clasps described in FIGS. 1A through 1D. The swivel ring 3 is constructed, attached to the rod with head, and functions with a purpose similar to that described in FIGS. 1A through 1D.

Figure 8A:
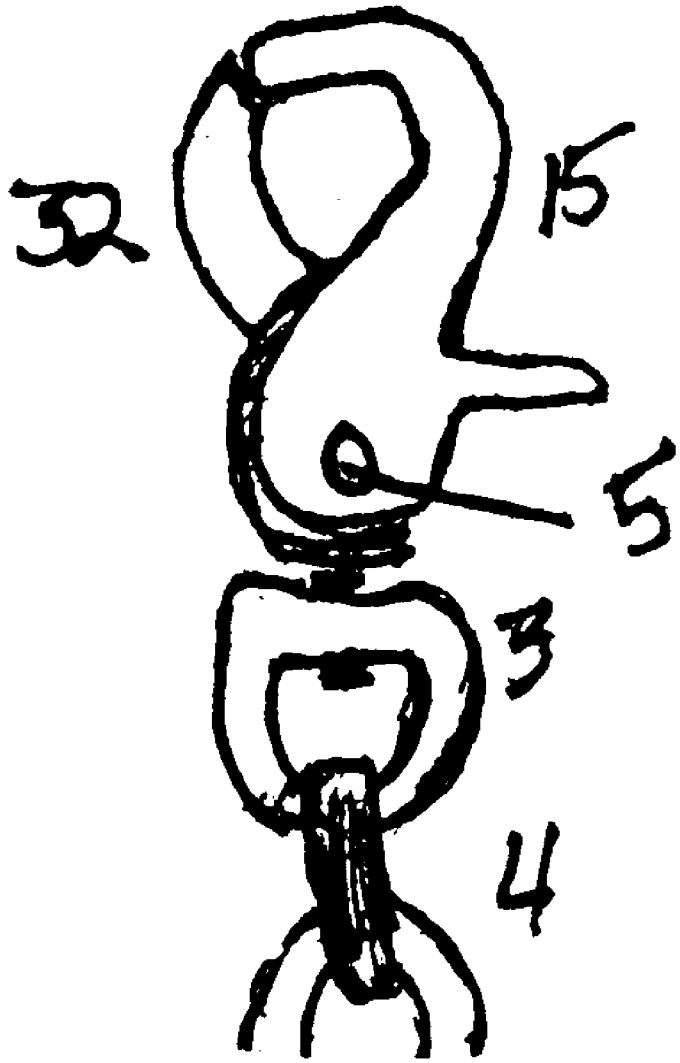
FIG. 8A shows a side perspective view of a self-closing clasp, useful in the Self-Closing Clasp Assemblies of the present invention, having an Interfacing Hinged-Hook Clasp.
Figure 8B:
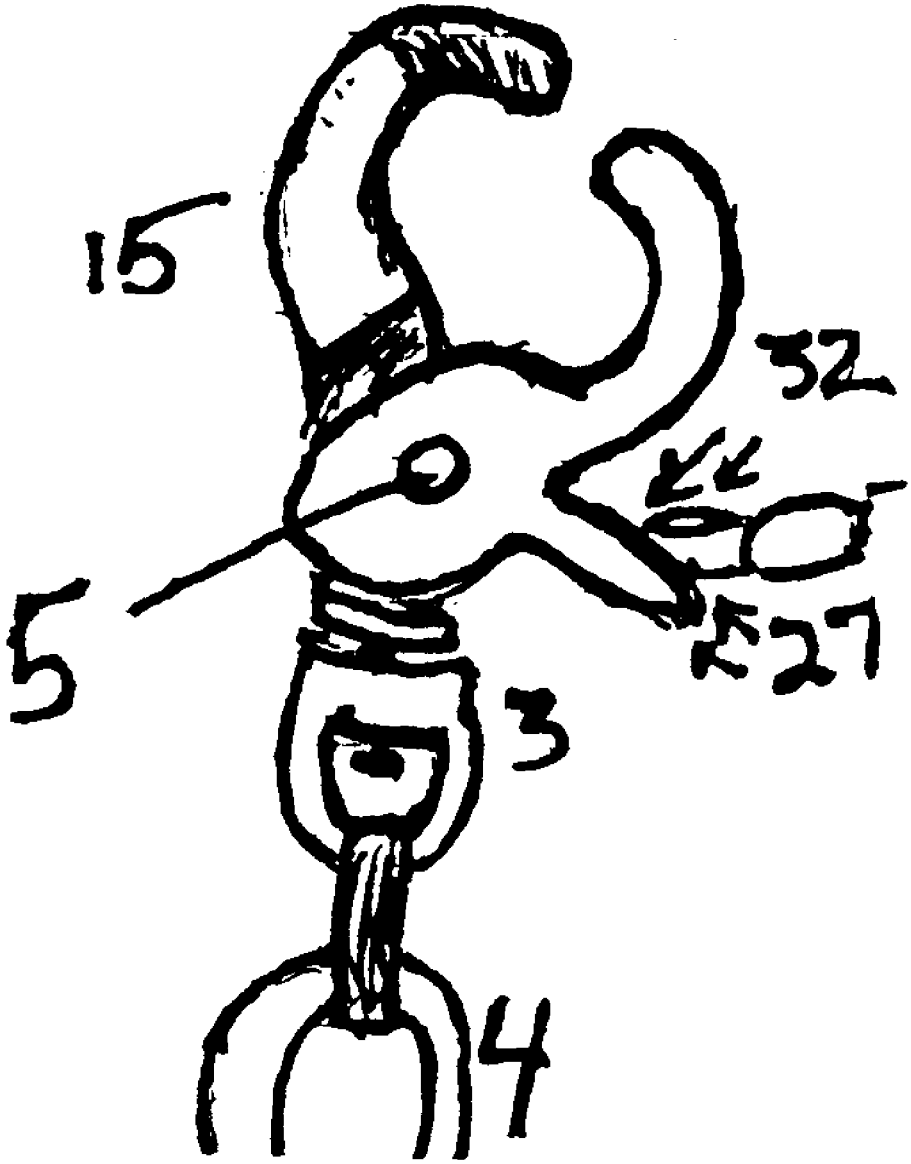
FIG. 8B shows a side perspective view of the Interfacing Hinged-Hook Clasp shown in FIG. 8A in the open position.
Figure 8C:
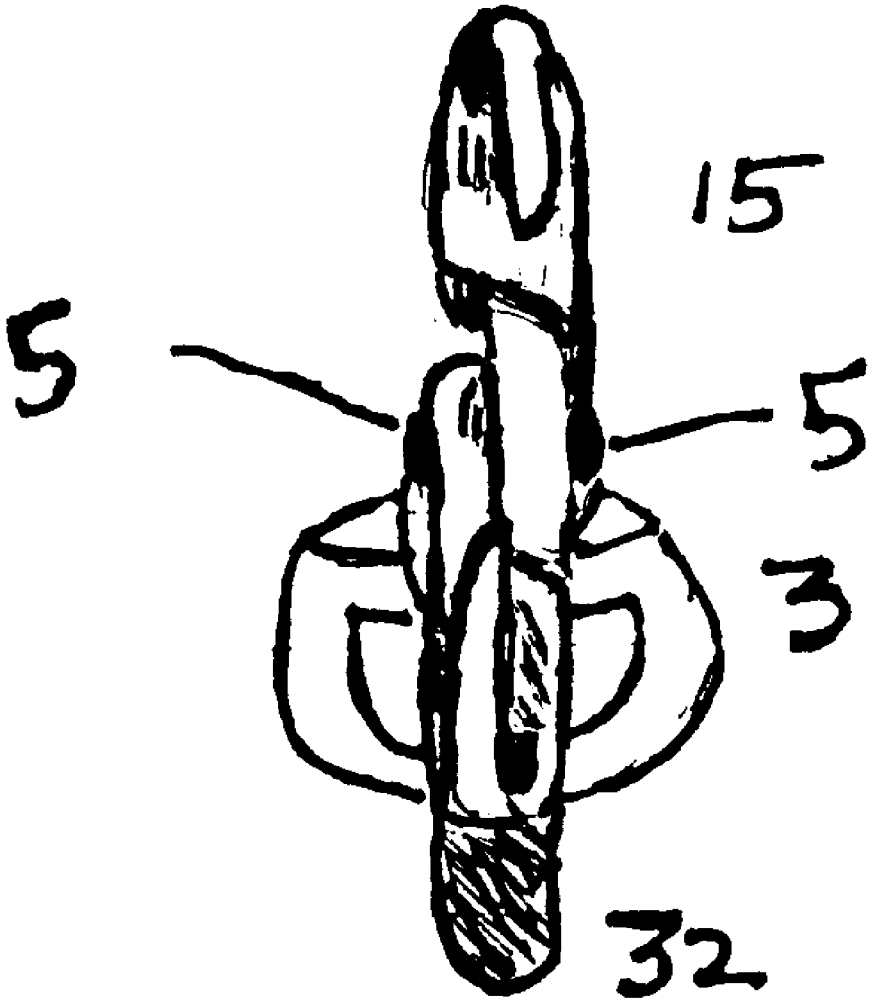
FIG. 8C shows a top perspective view of the Interfacing Hinged-Hook Clasp shown in FIG. 8A in the open position.
Figure 8D:
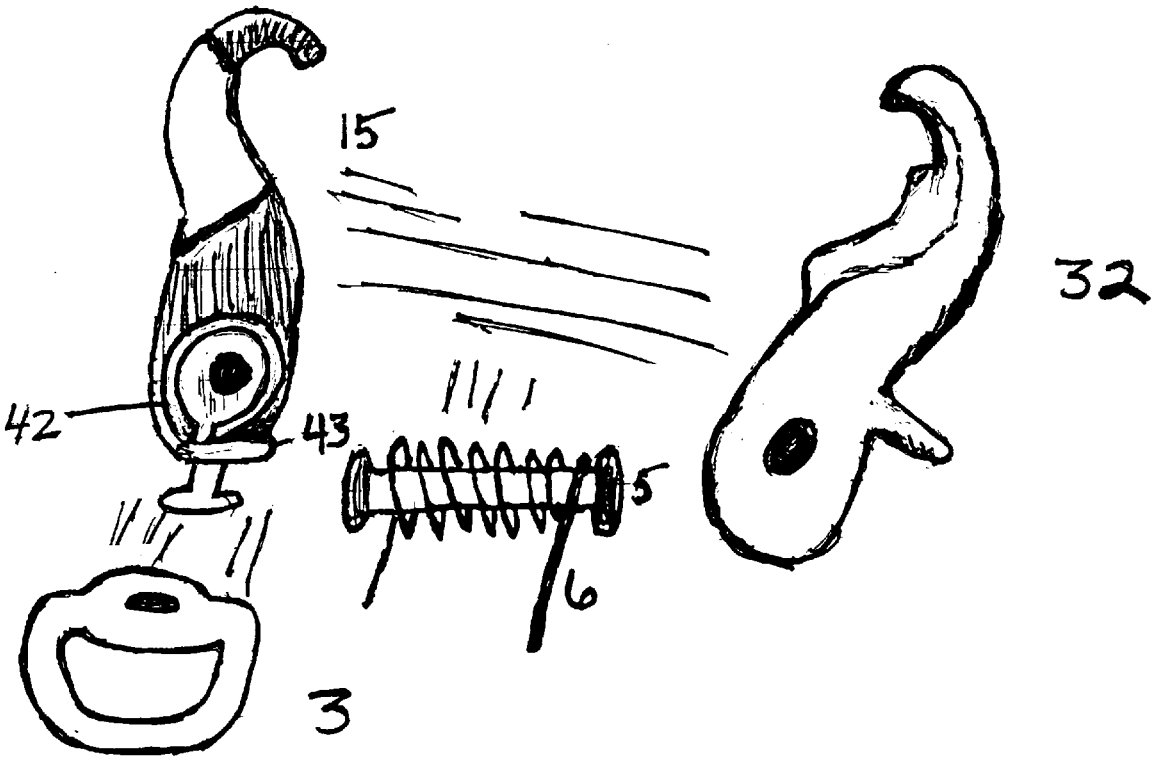
FIG. 8D shows a side perspective view of the Interfacing Hinged-Hook Clasp shown in FIG. 8A as its component parts fit together.
Figure 8E:
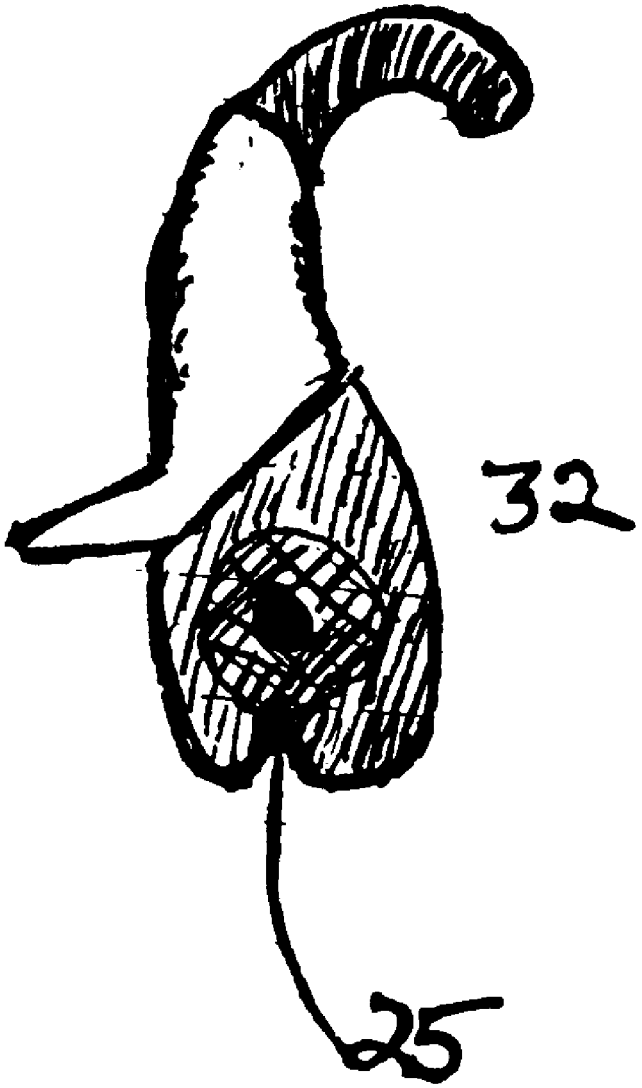
FIG. 8E a side perspective view of the inner side of the Interfacing Hinged-Hook with Rear Lever shown in FIG. 8A.
Figure 8F:
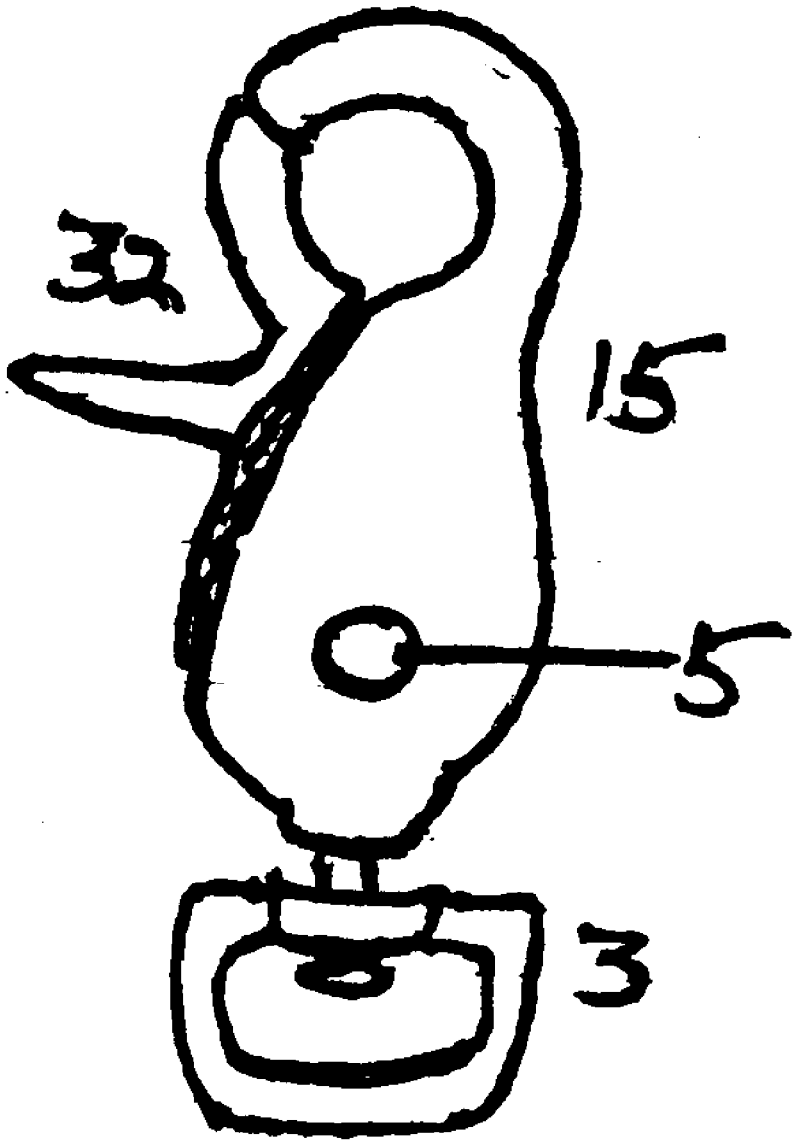
FIG. 8F is side perspective view of the reverse side of the Interfacing Hinged-Hook Clasp shown in FIG. 8A.

Another embodiment is shown in FIGS. 8A through 8F, which show a variation of the self-closing clasp that may be used in either the Self-Closing Element or Connecting Element position, and that is made of materials, is sized, and connects to the Elongated Element in a manner similar to that described in FIGS. 1A through 1D, but that is modified to meet user need. Variations of the type of self-closing clasp described in this embodiment may be found used to attach straps to handbags or as handbag closures. As shown in FIG. 8D, the Interfacing Hinged-Hook Clasp is comprised of five parts, an Interfacing Hinged-Hook with Rod Base 15, an Interfacing Hinged-Hook with Rear Lever 32, a fulcrum pin 5, a wire coil with straight extensions 6, and a swivel ring 3. As shown in FIGS. 8C and 8D, the Interfacing Hinged-Hook with Rear Lever 32 is hook-shaped, curving down to a tear-drop shaped base with a hole through the center of the tear-drop shaped base, and a flat lever extending out from the "back" of the Interfacing Hinged-Hook with Rod Base 15 at an area below the top of the base on the side and in the direction opposite the one that the hook points. As shown in FIG. 8D, one side of the Interfacing Hinged-Hook with Lever 32 has a smooth surface, with its edges rounding to its other side. As shown in FIG. 8E, the other side has a flat surface on the top-half of the hook. Below this flat surface, the surface raises to a slightly higher level, and its edges are rounded. The raised surface ends just below the area where the lever juts out of the "back", angling up to the other side of the top of the base. Below this raised area, the surface lowers to a flat level, which is the same level as that at the top of the hook, that extends to the bottom of the base. A further indentation to a slightly lower level that is circular with narrow channel 25 encircles the hole in the center of the base and continues into a narrow channel down to the bottom of the base. This circular with narrow channel 25 indentation is sized to allow the coil part of the wire coil with straight extensions 6 to sit within the indentation, and the nearest straight wire extension to lay in the narrow channel. In this position, the hole in the base and the hole through the wire coil with straight extensions 6 are aligned. As shown in FIGS. 8D and 8F, the Interfacing Hinged-Hook with Rod Base 15 is constructed in a similar manner to the Interfacing Hinged-Hook with Lever 32. The Interfacing Hinged-Hook with Rod Base 15 is hook-shaped curving down to a tear-drop shaped base, a hole in the center of the tear-drop shaped base, and a rod with a head emanating from the bottom of the base that will support a swivel 3. As shown in FIG. 8F, one side of the Interfacing Hinged-Hook with Rod Base 15 has a smooth surface, with the exception of the hole through the center, and its edges round to its other side. As shown in FIG. 8D, the other side has a flat surface on the top-half of the hook. Below this flat surface, the surface raises to a slightly higher level, and its edges are rounded. The raised surface ends on an angle drawn from the area just below the point where the hook widens into the base up to the side of the top of the base in which the hook points. The surface again lowers to another level, which is the same level as that at the top of the hook. This lower level surface extends toward the bottom of the base, where it meets a narrow ridge 43 that borders the bottom of the base. A raised ring 42 is formed around edges of the tear-drop shaped base with a narrow space left in the ring near the bottom of the base. The area between the raised ring 42 and the hole in the center of the base, and the narrow space at the bottom of the ring, are sized to allow the wire coil with straight extensions 6 to rest inside the space, around the hole, and to allow the nearest straight extension to lay in the narrow space. In this position, the hole in the base and the hole through the wire coil with straight extensions 6 are aligned. As shown in FIGS. 8A, 8D and 8F, when the Interfacing Hinged-Hook Clasp is assembled, the Interfacing Hinged-Hook with Rod Base 15 and the Interfacing Hinged-Hook with Lever 32 are fitted together so that the hooks form a ring when the clasp is at rest. The flat sides of the tops of each of the hooks interface and overlap, so that the two pieces slide together and apart easily when the self-closing clasp is opened and closed. As shown in FIG. 8D, the two pieces are held together by a fulcrum pin 5 that is inserted through the aligned holes in the tear-drop shaped bases of each piece, and is inserted through a wire coil with straight extensions 6 that is positioned between the aligned holes, in a manner and for a purpose similar to that described in FIGS. 1A through 1D. As described above and as shown in FIGS. 8D, 8E and 8F, one side of the wire coil with straight extensions 6 fits within the circular with channel further indentation 25, and is enclosed by the raised ring 42 with channel that fits around the circular with narrow channel further indentation 25 when the Interfacing Hinged Hook with Rear Lever 32 and Interfacing Hinged Hook with Rod Base 15 are fitted together. The wire coil with straight extensions 6 is placed within the clasp in a state of tension, in a manner similar to that described in FIGS. 1A through 1D. As shown in FIG. 8B, the self-closing clasp opens when downward pressure is applied to the lever, further compressing the wire coil with straight extensions 6. The swivel ring 3 is constructed, attached to the Elongated Element and to the rod with a head, and functions with a purpose similar in manner to that described in FIGS. 1A through 1D.

Figure 9:
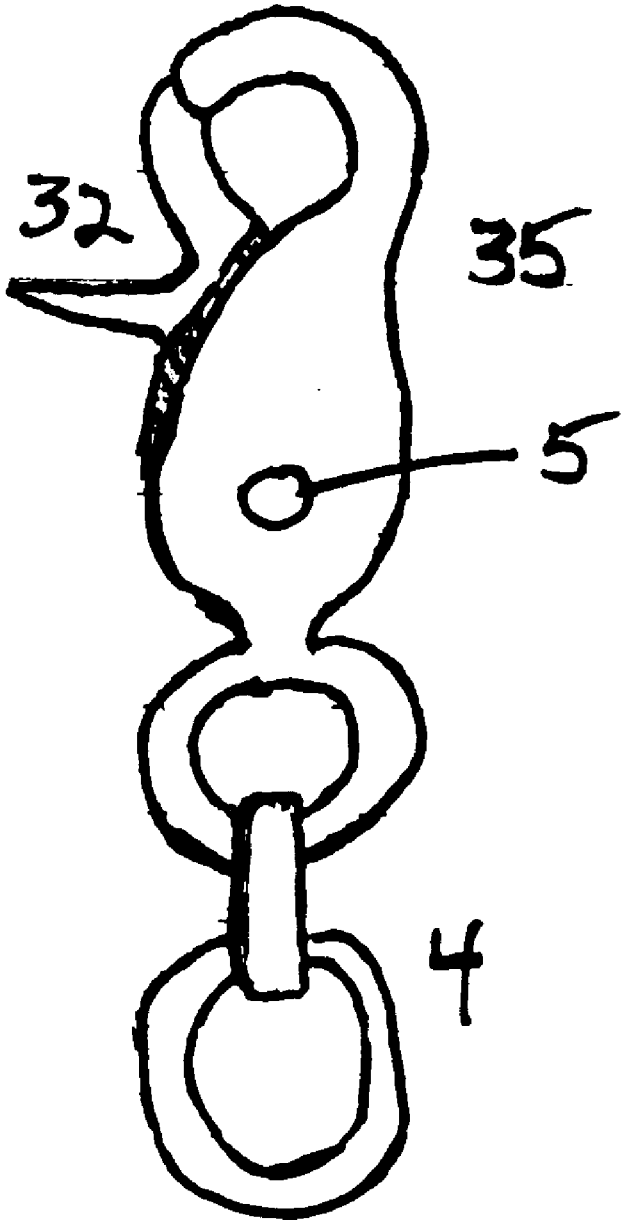
FIG. 9 is a side perspective view of a self-closing clasp useful in the Self-Closing Clasp Assemblies of the present invention comprising an Interfacing Hinged-Hook Clasp with a Ring Base.

Another embodiment is shown in FIG. 9, which shows a variation of the self-closing clasp that may be used in either the Self-Closing Element or Connecting Element position, and that is made of materials, is sized, and connects to the Elongated Element in a manner similar to that described in FIGS. 1A through 1D, and that is constructed and operates in a similar manner to that described in FIGS. 8A through 8F, but that is modified to meet user need. FIG. 9 illustrates the Interfacing Hinged-Hook Clasp with an Interfacing Hinged-Hook with Ring Base 35 that connects the clasp to the Elongated Element, the chain 4 in this embodiment.

Figure 10:
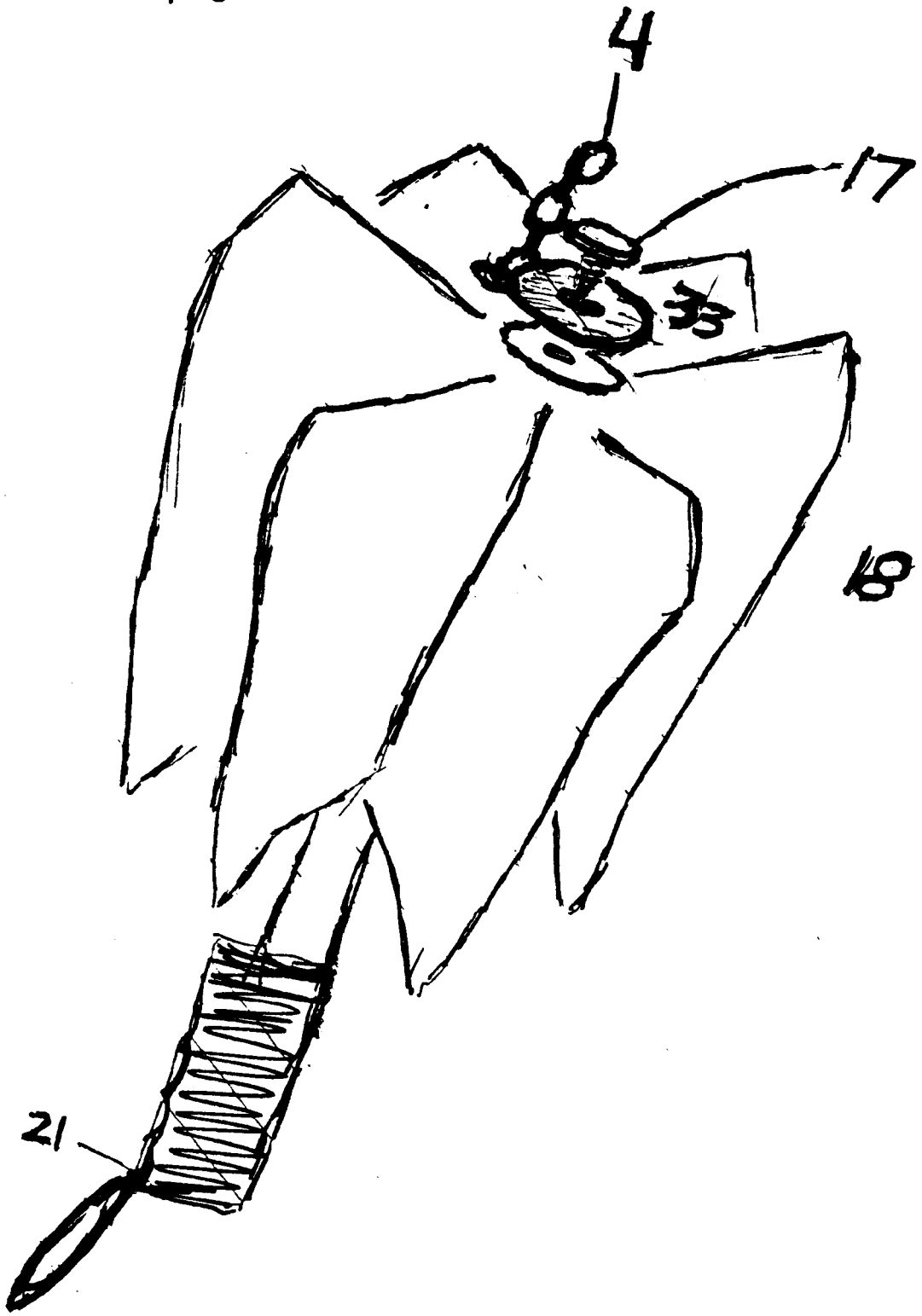
FIG. 10 is a top-angle perspective view of a Connecting Element useful in the Self-Closing Clasp Assemblies of the present invention comprising a flat washer-type ring with smaller ring affixed, as it is used with an umbrella (the loose object) and is connected to an Elongated Element.

Another embodiment is shown in FIG. 10, which is a variation of the Connecting Element and that is made of materials and connects to the Elongated Element in a manner similar to that described in FIGS. 1A through 1D, but that is modified to meet user need. As shown in FIG. 10, the Connecting Element in this embodiment is a flat washer-type ring with a small ring attached 33. The flat washer-type ring is sized to be thin enough and to have a hole sufficient in size to allow the screw portion of the finial 17 of an umbrella to pass through the hole in the center of the washer-type ring 33, when the finial 17 is screwed back into the top of the umbrella. The head of the finial 17 is sized to be larger than the hole in the center of the washer-type ring 33, and to remain firmly in place when the finial 17 is screwed back into place. The pressure applied against the washer-type ring by the head of the finial 17 holds the Connecting Element in place on top of the umbrella. The small ring attached to the flat washer-type ring 33 has either been welded onto the flat washer-type ring, or the unit has been manufactured as a single piece. The small ring is sized to allow it to connect with the Elongated Element, a chain 4 in this embodiment.

Figure 11A:
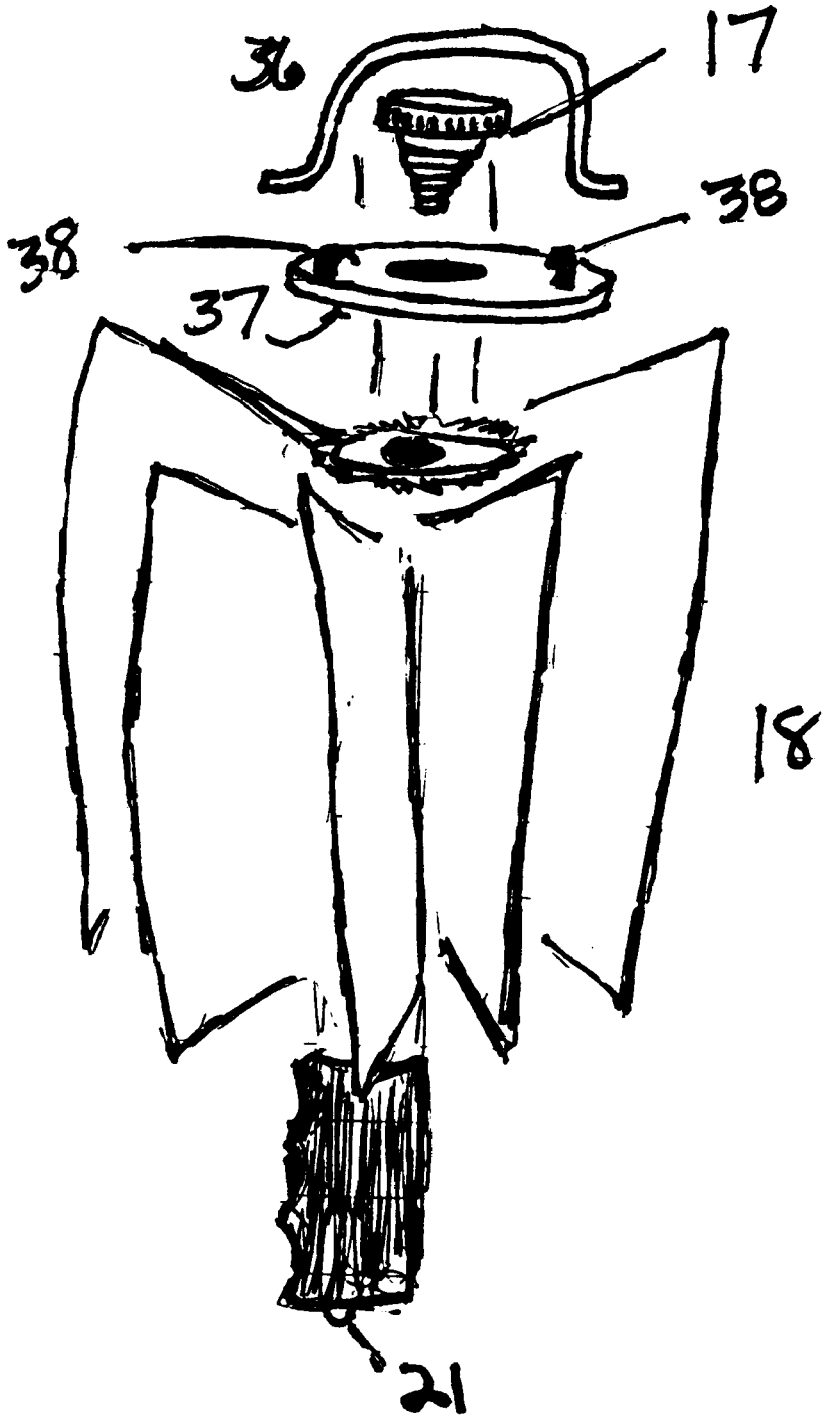
FIG. 11A shows a exploded side perspective view of a Connecting Element useful in the Self-Closing Clasp Assemblies of the present invention, comprising a flat washer-type ring with handle as it fits with an umbrella (the loose object) and finial.
Figure 11B:
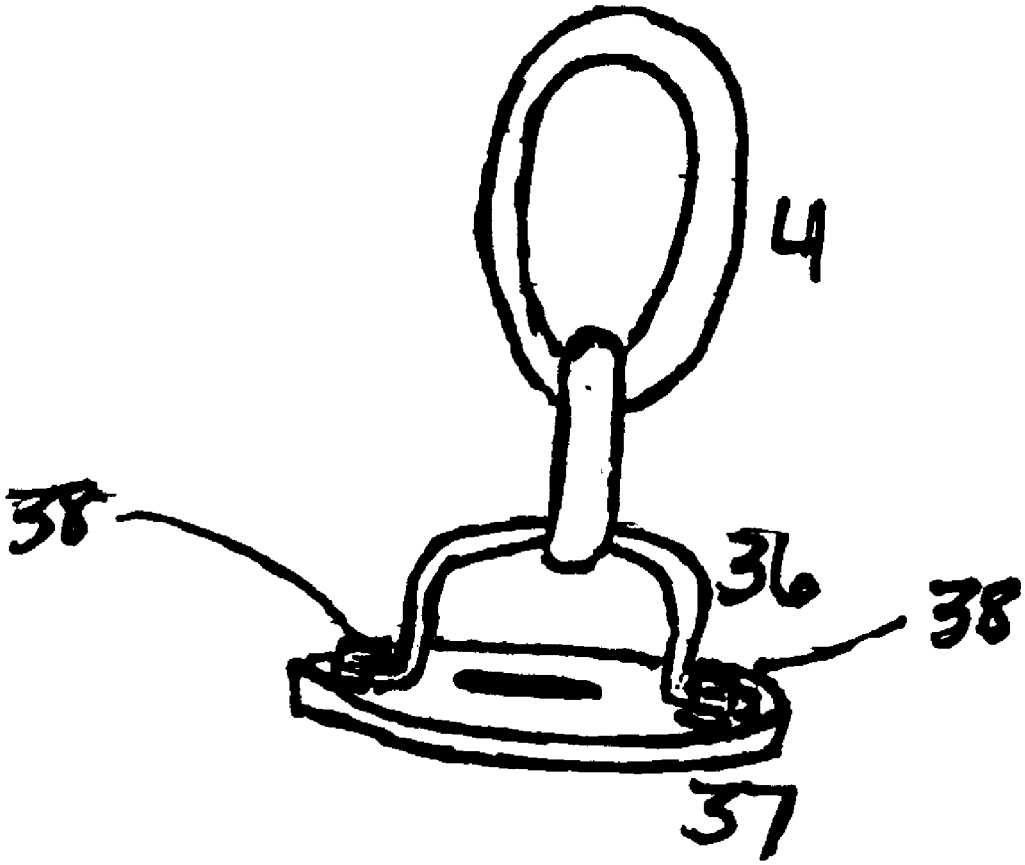
FIG. 11B is a side perspective view of the flat washer-type ring with handle shown in FIG. 11A as it attaches to a chain as the Elongated Element.
Figure 11C:
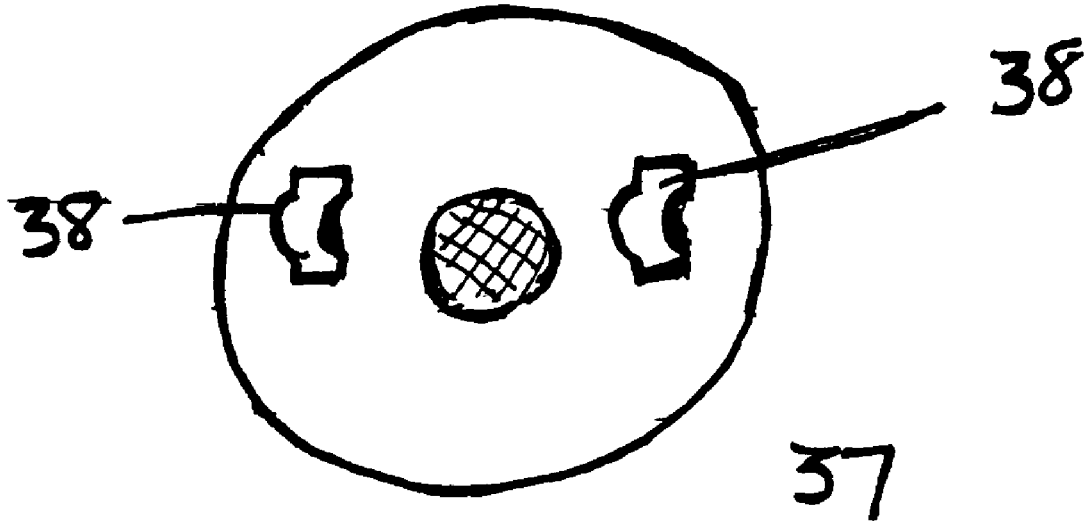
FIG. 11C is a top plan view of the flat washer-type ring shown in FIG. 11A showing the arches that hold the handle.

Another embodiment of the invention is shown in FIGS. 11A through 11C, which is a variation of the Connecting Element and that is made of materials and connects to the Elongated Element in a manner similar to that described in FIGS. 1A through 1D, and is similar in function, in use with the finial 17 and in sizing to the embodiment described in FIG. 10, but that is modified to meet user need. As shown in FIG. 11A, the Connecting Element in this embodiment is comprised of a flat washer-type ring 37 with two small arches 38 that are aligned and a separate handle 36. The small arches 38 are made of two small strips of rigid plastic or metal that are bent, with or without the use of heat to assist with the bending of the material, into arch shapes with flat tabs on each end. As shown in FIG. 11C, the two small arches 38 may be created by a method similar to gluing, riveting, welding or otherwise adhering the two flat tabs of the small arches 38 to the flat washer-type ring 37, so that the arches are placed on either side of the hole in the center of the flat washer-type ring 38 and are aligned. The small arches 38 are spaced far enough apart so that when the finial 17 is screwed in, the top of the finial presses firmly against the flat surface of the flat washer-type ring 37 between the aligned arches 38. The height, width and sturdiness of the small arches 38 are designed to be sufficiently strong and large to accommodate the handle 36, a thin piece shaped like a wire that is made of rigid yet flexible plastic or metal. The handle 36 is shaped into an elongated arch with short ends that extend in the direction parallel to the top of the elongated arch, as shown in FIG. 11A. The elongated arch of the handle 36 is sized so that its sides must be compressed slightly before the ends are inserted through the parallel arches 38. Once inserted between the arches, the sides of the handle 36 are released, so that they rest against the sides of the arches 38 with enough tension to allow the handle 36 to stay in place.

Figure 12:
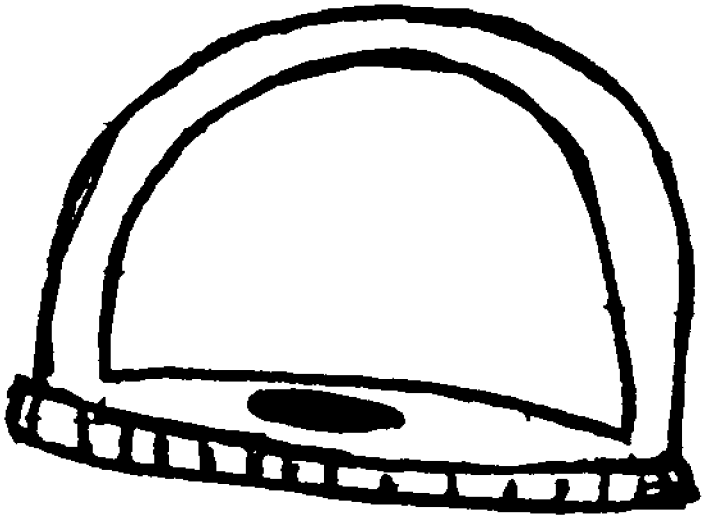
FIG. 12 is a side-angle perspective view of a Connecting Element useful in the self-closing assemblies of the present invention, comprising a flat washer-type ring with constructed arched handle.

Another embodiment of the invention is shown in FIG. 12, which is a variation of the Connecting Element and that is made of materials and connects to the Elongated Element in a manner similar to that described in FIGS. 1A through 1D, and is similar in construction, function, and sizing to that described in FIGS. 11A through 11C, but that is modified to meet user need. As illustrated in FIG. 12, the Connecting Element in this embodiment is a flat washer-type ring that is created with a handle arching over its diameter 40. The built-in handle is further sized to be large enough to allow a finial 17 to pass under the arched handle and the screw portion to fit through the hole in the center of the flat washer-type ring, down through the hole in the top of the umbrella as described in FIGS. 11A through 11C.

Figure 13:
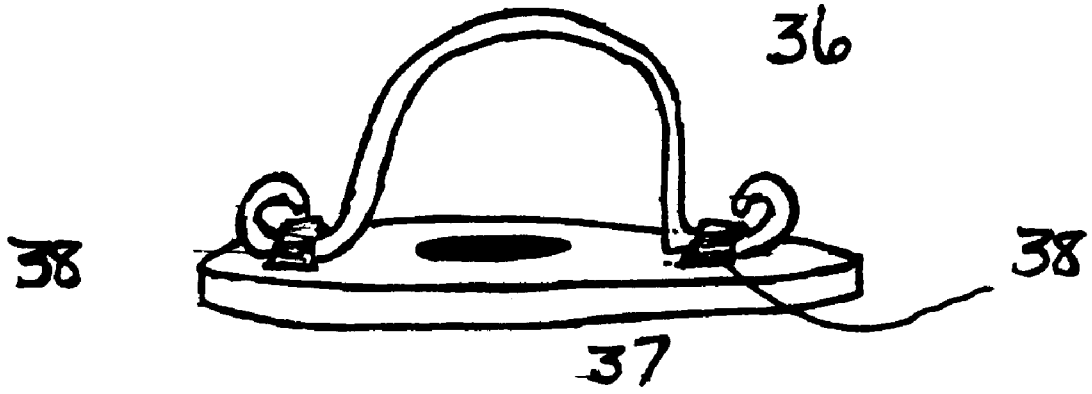
FIG. 13 is a side perspective view of a Connecting Element useful in the Self-Closing Clasp Assemblies of the present invention, comprising a flat washer-type ring with arches for holding a handle that has ends that curve.

Another embodiment of the invention is shown in FIG. 13, which shows a variation of the Connecting Element, and is similar in operation, function, construction, sizing, connection to the Elongated Element, and use with the finial 17 as that described in FIGS. 10 and 11A through 11C, and that is made of materials similar to that described in FIGS. 1A through 1D, but that is modified to meet user need. FIG. 13 illustrates a flat-washer type ring with aligned arches and a variation of the handle 36 that has ends that are curved upward after insertion through the aligned small arches 38, replacing the need for tension to hold the handle 36 in place.

Figure 14A:
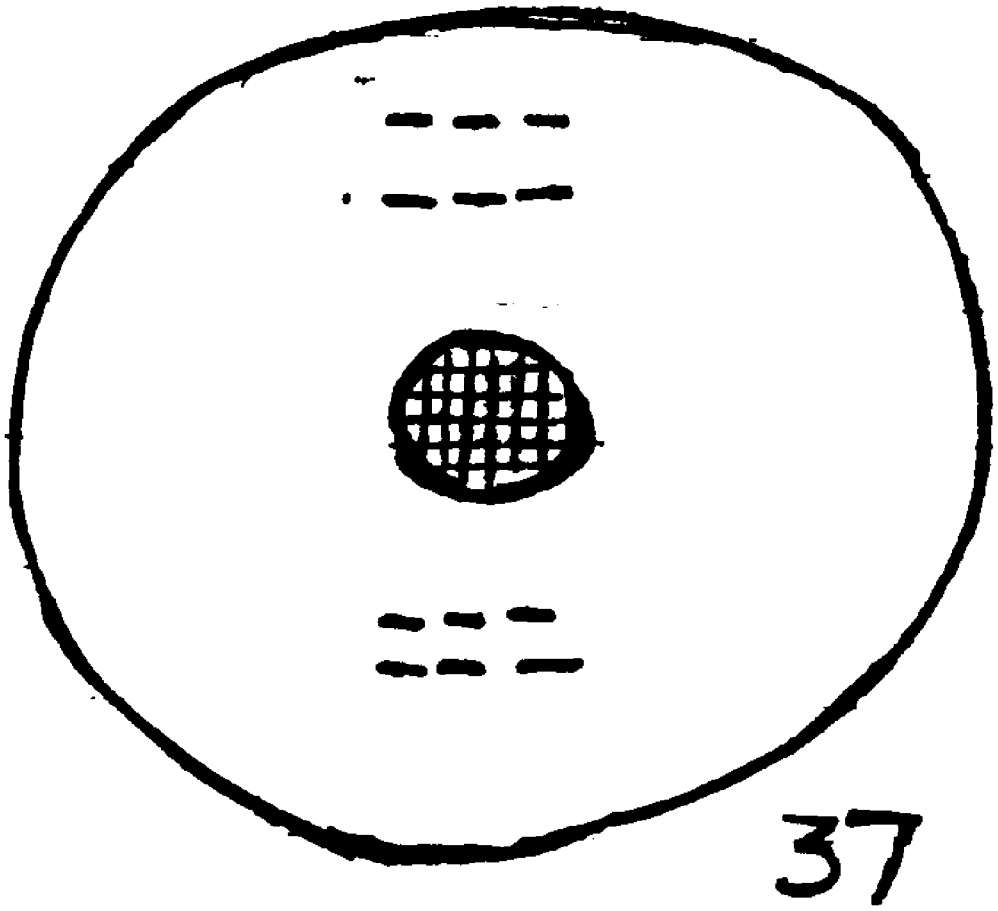
FIG. 14A shows a top plan view of a Connecting Element useful in the Self-Closing Clasp Assemblies of the present invention, comprising a flat washer-type ring in which incisions are made to create arches.
Figure 14B:
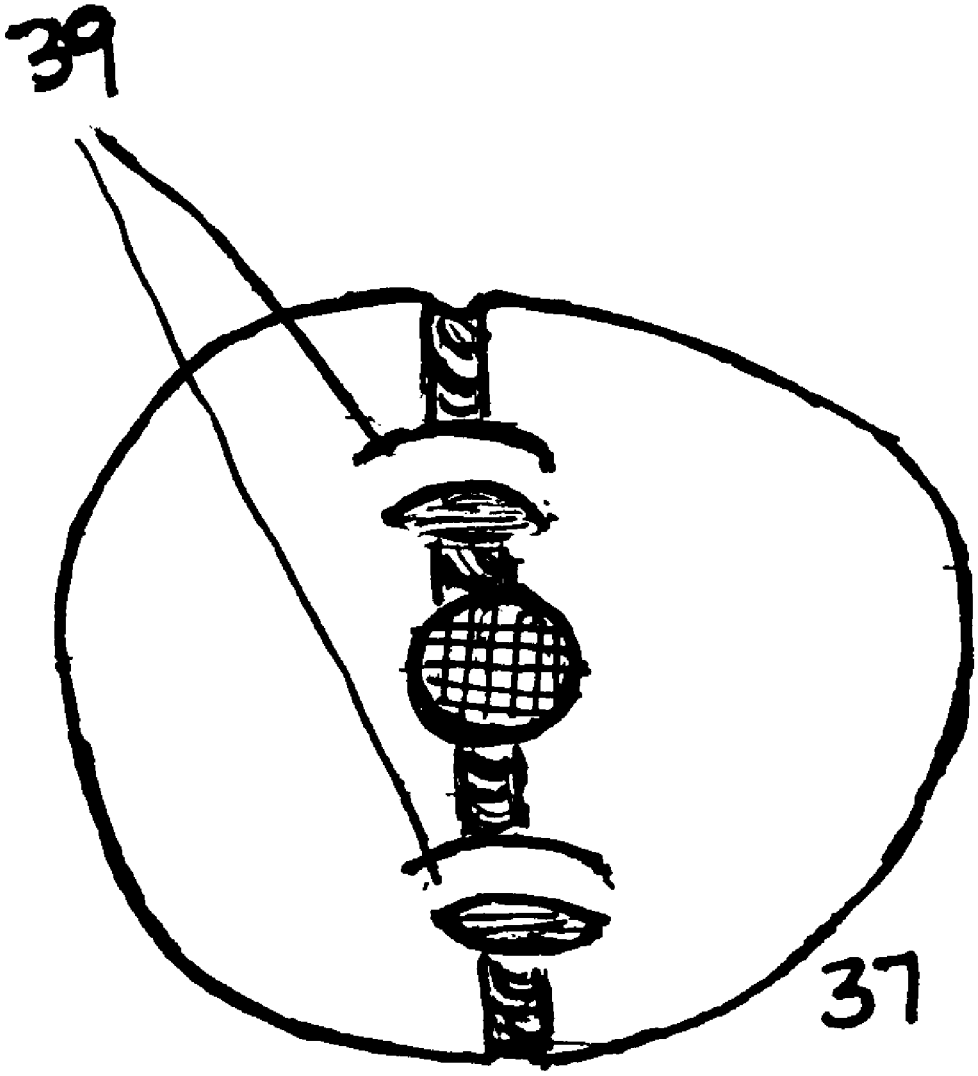
FIG. 14B shows a top perspective view of the Connecting Element shown in FIG. 14A showing arches as they are formed through incisions and compression of the piece.

Another embodiment of the invention is shown in FIGS. 14A and 14B, which show a variation of the Connecting Element, and is similar in operation, function, connection to the Elongated Element, use with the finial 17, and sizing as described in FIGS. 11A through 11C, and that is made of materials in a manner similar to that described in FIGS. 1A through 1D, but that is modified to meet user need. FIG. 14A illustrates a variation of the aligned arches that may be created by cutting four short parallel lines, two on each side of the hole in the center of the flat washer-type ring. As shown in FIG. 14B, the two areas between the set of parallel lines on each side of the hole are pressed upward, and a narrow channel the length of the diameter of the washer-type ring 37 is pressed into the area under the arches, creating two small arches 39. The handle 36 is inserted into the arches 39 and may be secured in a manner similar to that described in FIGS. 11A through 11C, or in FIG. 13.

Figure 15:
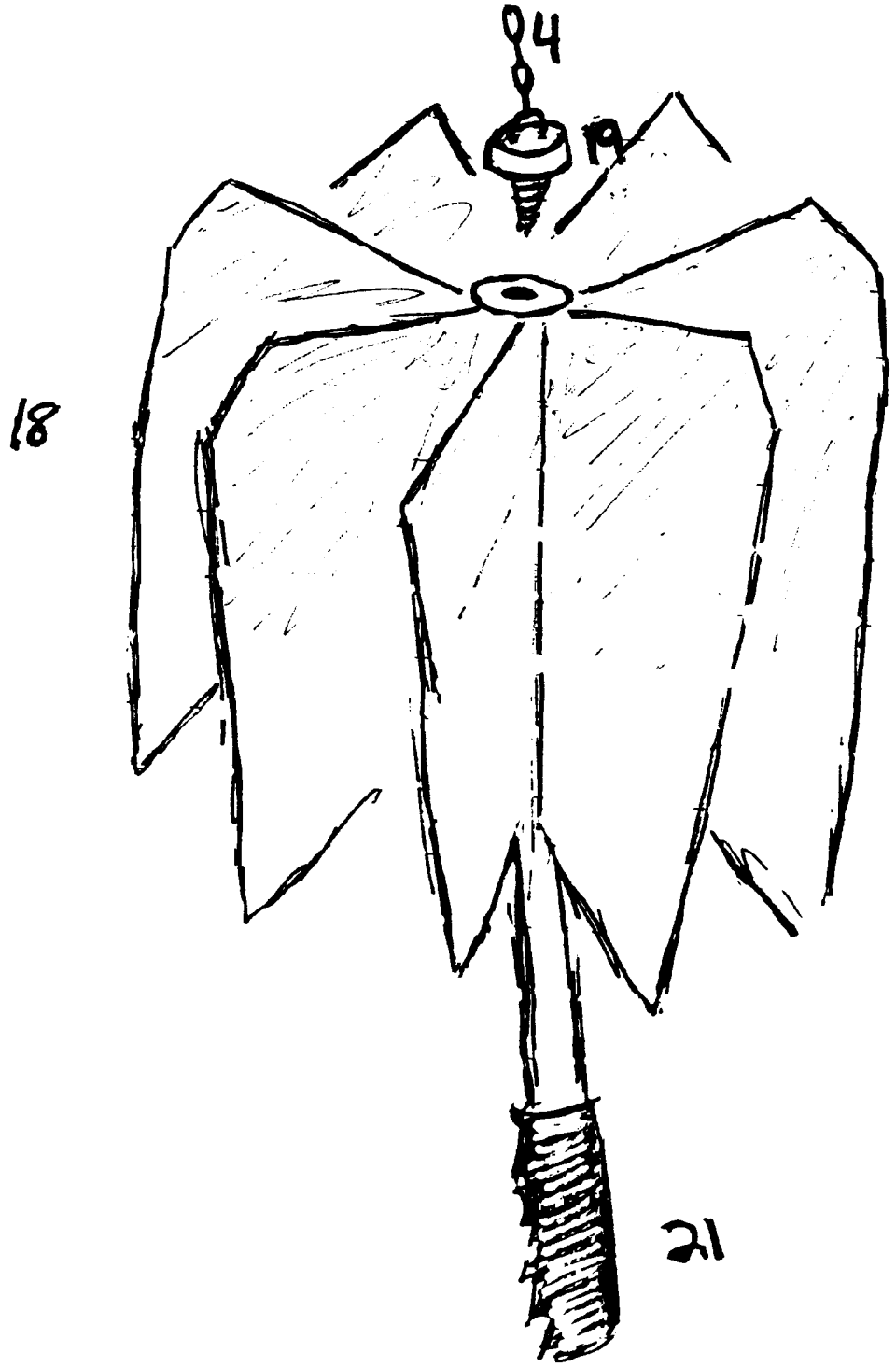
FIG. 15 shows a top perspective view of a Connecting Element useful in the Self-Closing Clasp Assembly of the present invention, comprising a finial screw with a ring on its top, as it fits with an umbrella (the loose object).

Another embodiment of the invention is shown in FIG. 15, which shows a variation of the Connecting Element, and is similar in purpose to the embodiment as described in FIGS. 11A through 11C, and that is made of materials and connects to the Elongated Element in a manner similar to that described in FIGS. 1A through 1D, but that is modified to meet user need. FIG. 15 shows a finial with a ring on its top 19. This finial 19 is a screw that is sized and manufactured to fit as the finial of the umbrella, and may replace the original finial of an umbrella. The Elongated Element attaches to the Connecting Element by the ring that is manufactured to be the top of the finial with a ring on its top 19.

Figure 16A:
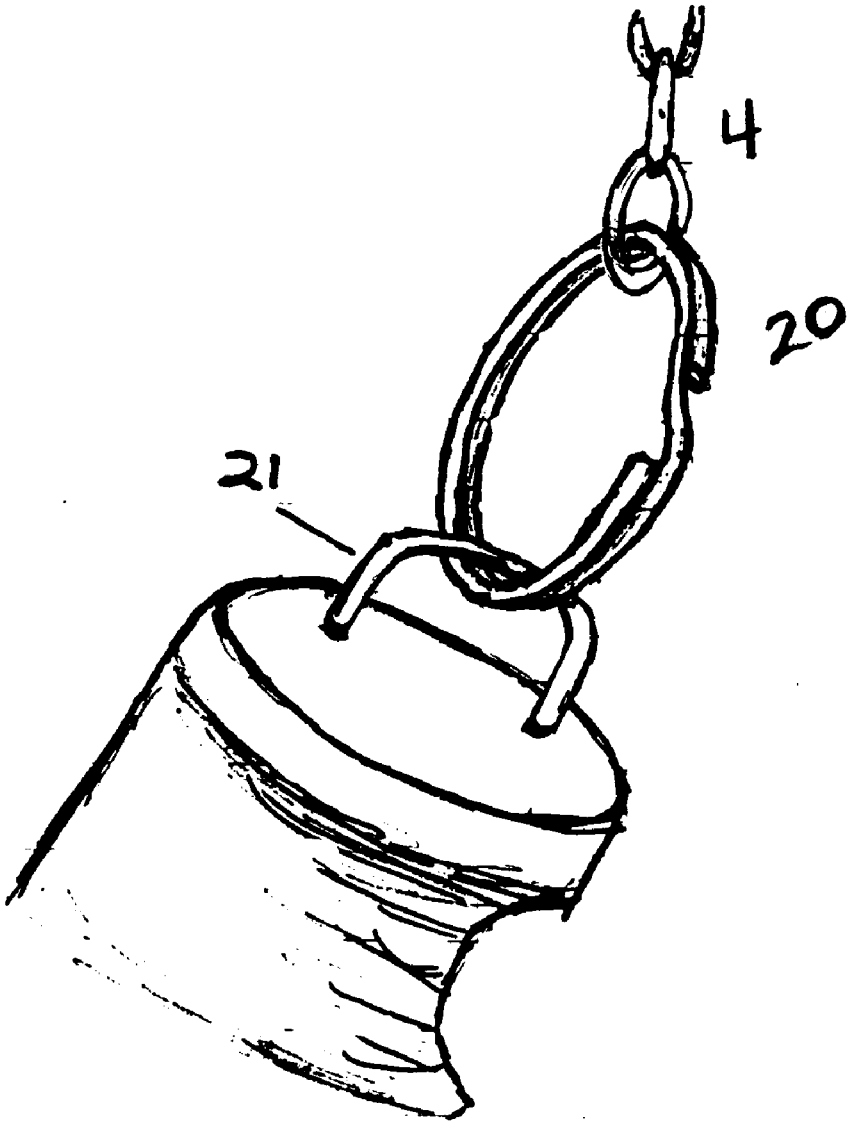
FIG. 16A is a side perspective view of a Connecting Element useful in the Self-Closing Clasp Assemblies of the present invention, comprising an "O-Ring" Connector which attaches to a chain and to a ring on an umbrella handle.
Figure 16B:
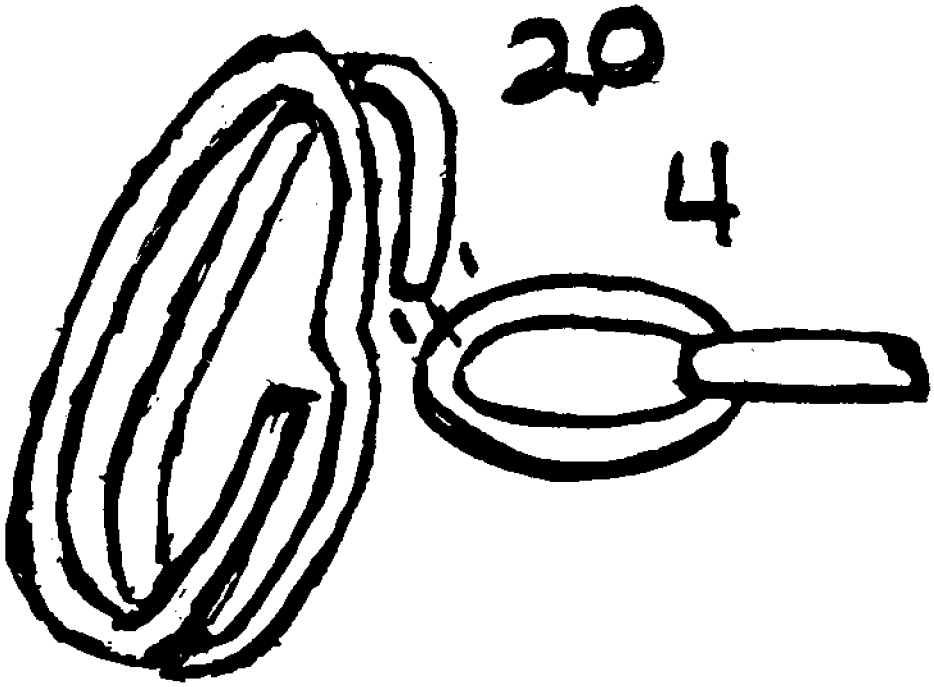
FIG. 16B shows a side-angle perspective view of the Connecting Element shown in FIG. 16A, in the "open" position so that a chain can enter it.

Another embodiment of the invention is shown in FIGS. 16A and 16B, which show a variation of the Connecting Element that is similar in purpose and in sizing to the embodiment described in FIG. 15, and that connects to the Elongated Element in a manner similar to that described in FIGS. 1A through 1D, but that is modified to meet user need. Variations of the type of self-closing clasp described in this embodiment may be found in objects such as key chains or used to connect lifeguard whistles to lanyards. The difference between the use in a key chain and the use described in the present embodiment in the present invention is in the sizing and sturdiness, which in the present embodiment, is similar to that described in FIGS. 1A through 1D. FIG. 16A illustrates a variation of the Connecting Element, which is an "O-Ring" 20, as it connects to a hoop or ring portion of an umbrella handle 21. The "O-Ring" 20 is made of light and flexible, yet sturdy, metal or plastic in the shape of a wire, that is tightly-coiled in a circular manner twice, so that the two ends of the "O-Ring" 20 stop at almost the same aligned point on their separate levels in the coil. The center "wire" in the coil of the "O-Ring" 20 may be bent in the area between the two ends, depending upon user preference. The two ends lie tightly flush against the center coil. Entry is gained into the "O-Ring" 20 by prying one of the ends of the "O-Ring" 20 apart from the center coil, then by sliding an object through the coils of the "O-Ring" 20 into the center. FIG. 16B shows the "O-Ring" 20 in its completely open state, after it has been completely pried apart, and as a chain 4 is to be entered into the "O-Ring" 20, which is also an alternate method for the "O-Ring's connection to the Elongated Element. The "O-Ring" 20, is sized and is sturdy enough to support the Elongated Element and either the umbrella via its hook or ring on its handle 21 or any other relatively smaller object.

Figure 17:
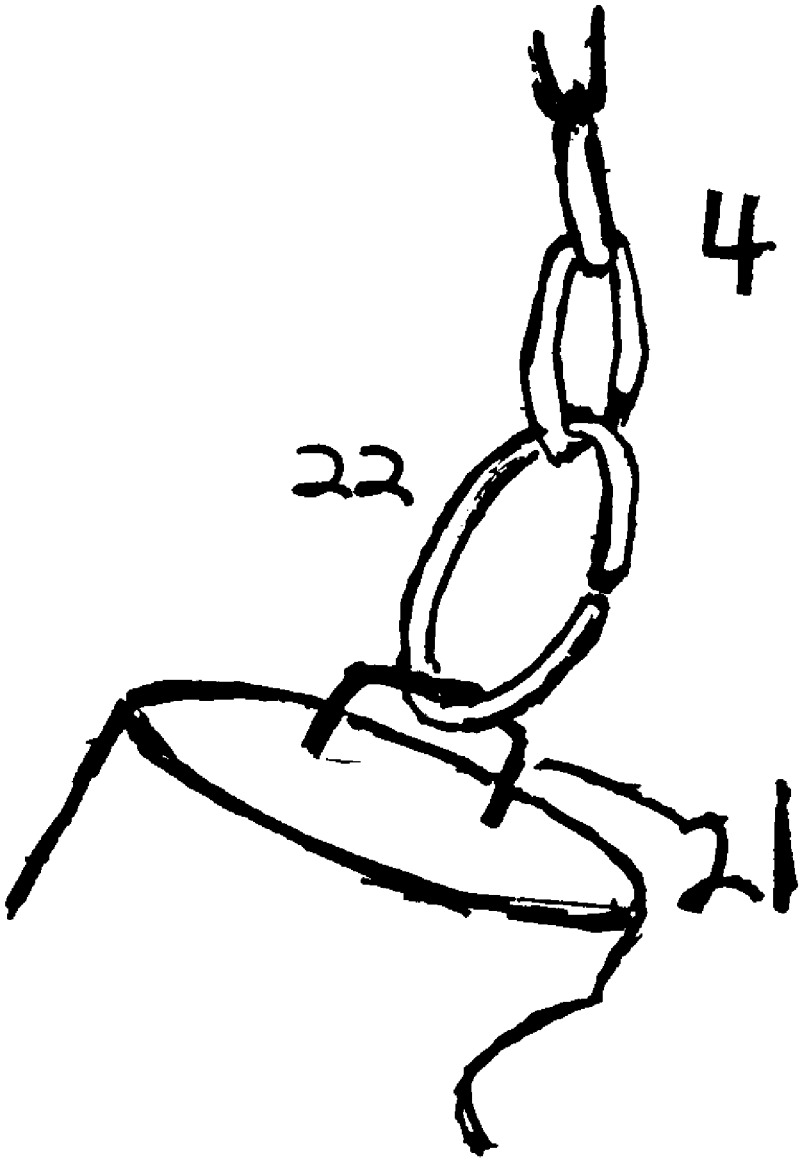
FIG. 17 shows a side perspective view of a Connecting Element useful in the Self-Closing Clasp Assemblies of the present invention, comprising a Clamped Closure "O-Ring" which attaches to a chain (the Elongated Element) and to a ring on an umbrella handle (the loose object).

Another embodiment of the invention is shown in FIG. 17, which shows a variation of the Connecting Element that is similar in purpose, materials, is sized, function, and that connects to the Elongated Element to the embodiment in a manner that is similar to that described in FIGS. 16A and 16B, but that is modified to meet user need. Variations of the type of self-closing clasp described in this embodiment may be found in objects such as costume jewelry as a chain attaches to a clasp or in other object of lesser value and quality that requires an inexpensive means of connecting its component parts or connecting the object to another object. The difference between the use in the costume jewelry and the use described in the present embodiment in the present invention is in the sizing and sturdiness, which in the present embodiment, is similar to that described in FIGS. 1A through 1D. FIG. 17 shows a Clamped Closure "O-Ring" 22, which is a light, yet sturdy metal or plastic "wire" that is bent in a ring so that its ends meet. The Clamped Closure "O-Ring" 22 is affixed to the hoop or ring manufactured as part of an umbrella handle 21.

Figure 18:
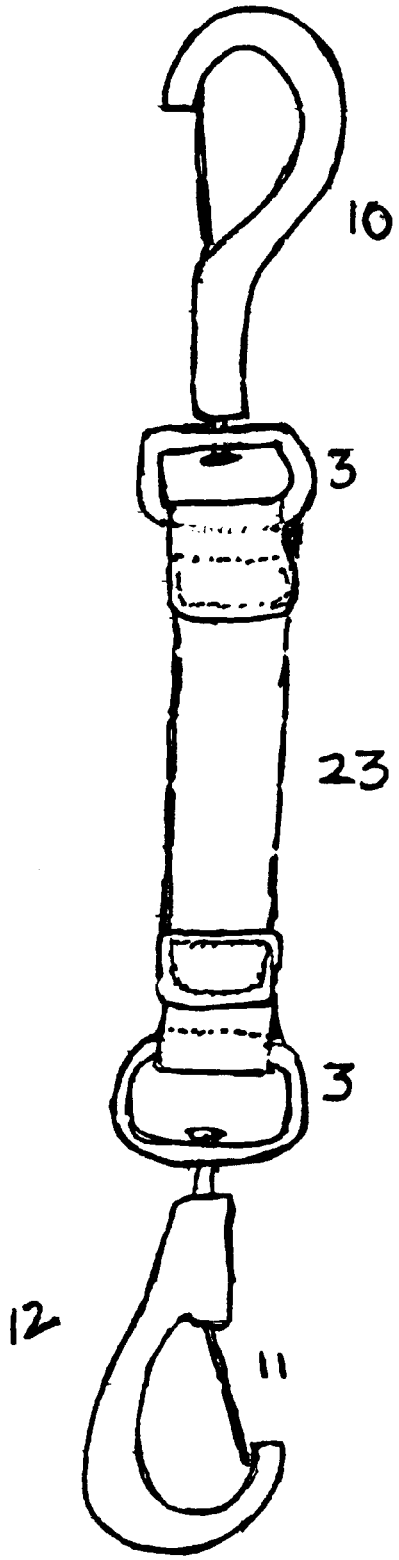
FIG. 18 shows a side perspective view of an Elongated Element useful in the Self-Closing Clasp Assembly of the present invention, comprising a strap.

A type of Elongated Element is shown in FIG. 18. This embodiment connects the Self-Closing Element and Connecting Element with a purpose and function, and is sized, in a manner that is similar to that described in FIGS. 1A through 1D, FIGS. 4A through 4E, FIGS. 16A and 16B, and FIG. 17, but that is modified to meet user need. In FIG. 18, the Elongated Element is made of a strap 23. In each, the ends of the straps are looped over the base of the swivel ring 3 on the Unit "D-Ring" and around the ring base of the "D-Ring" with Ring Base, and may be sewn, glued, woven, welded, clamped, riveted, or seared in place. The Unit "D-Ring" and the "D-Ring" with Ring Base are similar to those described in FIGS. 4A through 4E. This variation of the Elongated Element is among many possibilities, such as straps made of webbing, natural or synthetic fibers, leather, plastic, nylon, metal, wooden or other ornamental pieces that may be braided, woven, interlocked, formed into bars or other decorative shapes, and that would support Self-Closing Element and the Connecting Element. These variations may be found in watch bands, bracelets, belts, bag straps, key chains, chains and other such items. The Elongated Element differs from these variations in the strength and sturdiness, and also in the length. The Elongated Element is sized to allow the user to hang a relatively small object to a structural object such as a handbag. The length must be long enough to accommodate the human use of the various parts of the Self-Closing Clasp Assembly, and it must be short enough so that the hanging object does not hit the ground or otherwise obstruct free use. The Elongated Element is to be created in different ways, to meet user preference.

Figure 19A:
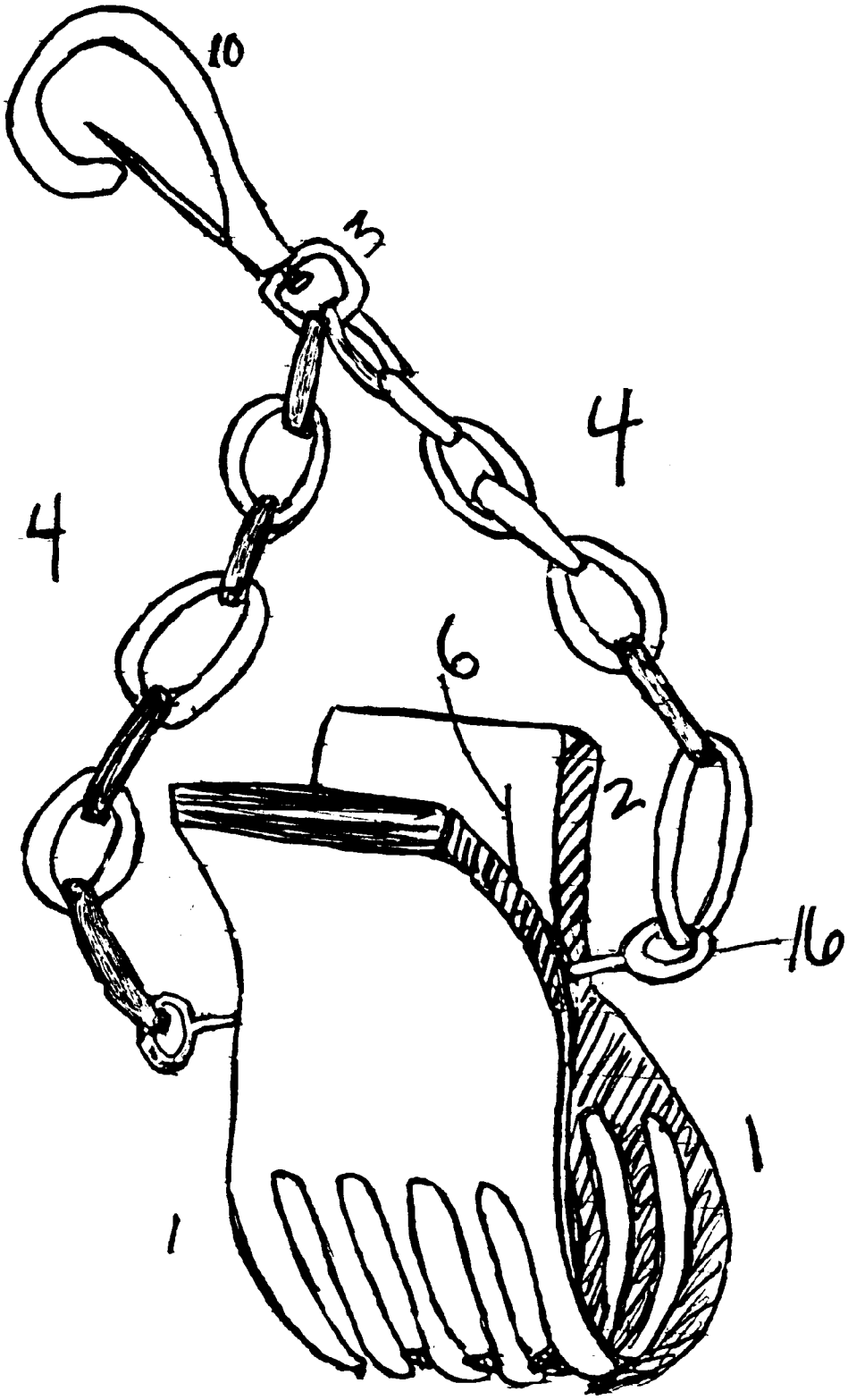
FIG. 19A shows a side perspective view of an embodiment of the Self-Closing Clasp Assembly of the present invention comprising, a Unit "D-Ring" with two chains connecting it to a fulcrum pin with rings on both ends that is inserted into an interlocking concave-curved teeth self-closing clasp.
Figure 19B:
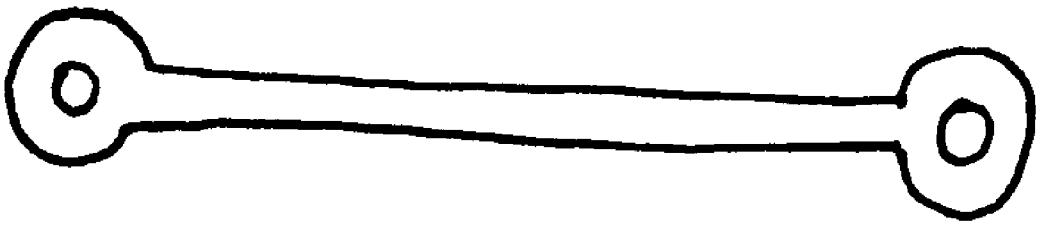
FIG. 19B shows a side plan view of the fulcrum pin with rings on each end shown in FIG. 19A.

Another embodiment of the Self-Closing Clasp Assembly of the invention is seen in FIGS. 19A and 19B. In the Self-Closing Element position, is a Unit "D-Ring" self-closing clasp with swivel ring 3, similar to that described in FIGS. 4A through 4E. The Elongated Element in this embodiment consists of two chains 4 that are both connected on one end to the swivel ring 3 that is located at the base of the Unit "D-Ring", and on the other end, each chain 4 is connected to a ring on either side of the fulcrum pin with rings on each end 16 in a manner, function, purpose, materials, and construction similar to that described in FIGS. 1A through 1D. The concave-curved interlocking-teeth clasp in the Connecting Element position is similar in function, purpose, materials, and construction to that described in FIGS. 1A through 1D. As shown in FIG. 19B, the fulcrum pin in this embodiment has one ring in each end. The rings of the fulcrum pin with rings on each end 16 are sized to be large enough and far enough apart from each other to stay firmly in place on the outside of the buttressing supports, in a manner that is similar to that described in FIGS. 1A through 1D and in FIGS. 3A through 3C.

What is claimed is:

1. A Self-Closing Clasp Assembly comprising:

(a) a Self-Closing Element;

(b) an Elongated Element connected to the Self-Closing Element; and (c) a Connecting Element connected to the Elongated Element;

wherein the Self-Closing Element and the Connecting Element are positioned opposite each other, and wherein one or both of the Self-Closing Element and the Connecting Element is substantially concave, and wherein the Self-Closing Element and the Connecting Element comprise:

(i) cooperating members shaped and configured to provide a closed and open position to attach an article, and (ii) a self-closing means for biasing the members to the closed position.

2. The Self-Closing Clasp Assembly of claim 1, wherein the Self-Closing Element is a self-closing clasp.

3. The Self-Closing Clasp Assembly of claim 1, wherein the Connecting Element is a self-closing clasp.

4. The Self-Closing Clasp Assembly of claim 2, wherein the self-closing clasp comprises concave-curved, interlocking-teeth clasp halves.

5. The Self-Closing Clasp Assembly of claim 2, wherein the self-closing clasp comprises a D-ring.

6. The Self-Closing Clasp Assembly of claim 2, wherein the self-closing clasp comprises a self-closing hook.

7. The Self-Closing Clasp Assembly of claim 1, wherein the Connecting Element comprises a finial.

8. The Self-Closing Clasp Assembly of claim 3, wherein the self-closing clasp comprises concave-curved, interlocking-teeth clasp halves.

9. The Self-Closing Clasp Assembly of claim 3, wherein the self-closing clasp comprises a D-ring.

10. The Self-Closing Clasp Assembly of claim 3, wherein the self-closing clasp comprises a self-closing hook.

11. The Self-Closing Clasp Assembly of claim 1, wherein the Elongated Element comprises a leather strap.

12. The Self-Closing Clasp Assembly of claim 1, wherein the Elongated Element comprises a chain.

13. The Self-Closing Clasp Assembly of claim 1, wherein the Elongated Element comprises a plastic strap.

14. The Self-Closing Clasp Assembly of claim 1, wherein the Self-Closing Element is a D-ring, the Elongated Element is a short plastic chain, and the Connecting Element is a finial.

15. The Self-Closing Clasp Assembly of claim 1, wherein both the Self-Closing Element and the Connecting Element are self-closing clasps comprised of interlocking-teeth clasp halves and the Elongated Element is a chain.

16. The Self-Closing Clasp Assembly of claim 1, wherein the Self-Closing Element is a self-closing clasp comprised of interlocking-teeth clasp, the Connecting Element is a D-ring and the Elongated Element is a leather strap.

17. The Self-Closing Clasp Assembly of claim 1, wherein the Connecting Element comprises an O-ring.

18. The Self-Closing Clasp Assembly of claim 1, wherein the Elongated Element comprises a strap of webbing.

19. The Self-Closing Clasp Assembly of claim 3, wherein the self-closing clasp of the Connecting Element comprises concave-curved, interlocking teeth clasp halves pivotably coupled about a fulcrum pin and having a ring on each side of the fulcrum pin, and the Elongated Element comprises two short chains, attaching to the Self-Closing Element and to the rings on each end of the fulcrum pin of the Connecting Element.

* * * * *